US010082757B1

(12) United States Patent
Cook

(10) Patent No.: US 10,082,757 B1
(45) Date of Patent: Sep. 25, 2018

(54) METHOD TO CONTROL TRANSFER OF BLACK AND COLOR TONED IMAGES DURING COMBINED SIMPLEX DUPLEX PRINTING

(71) Applicant: LEXMARK INTERNATIONAL, INC., Lexington, KY (US)

(72) Inventor: William Paul Cook, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/722,026

(22) Filed: Oct. 2, 2017

(51) Int. Cl.

| | |
|---|---|
| ***G03G 15/00*** | (2006.01) |
| ***G03G 15/23*** | (2006.01) |
| ***G03G 15/20*** | (2006.01) |
| ***B65H 29/12*** | (2006.01) |

(52) U.S. Cl.
CPC ..... *G03G 15/235* (2013.01); *B65H 29/12* (2013.01); *G03G 15/2025* (2013.01); *G03G 15/2064* (2013.01); *G03G 2215/2083* (2013.01); *G03G 2215/2093* (2013.01)

(58) Field of Classification Search
CPC .. B65H 29/12; G03G 15/235; G03G 15/2025; G03G 15/2064
See application file for complete search history.

(56) References Cited

U.S. PATENT DOCUMENTS

| | | | | |
|---|---|---|---|---|
| 5,095,342 A * | 3/1992 | Farrell | G03G 15/234 | 355/23 |
| 8,000,645 B2 * | 8/2011 | Dobbertin | G03G 15/238 | 399/364 |
| 8,695,972 B2 * | 4/2014 | Choi | B65H 5/26 | 271/184 |
| 2009/0232538 A1 * | 9/2009 | Cook | G03G 15/01 | 399/82 |

* cited by examiner

*Primary Examiner* — Walter L Lindsay, Jr.
*Assistant Examiner* — Jessica L Eley

(57) ABSTRACT

A method for controlling transfer of black and color toned images during combined simplex and duplex printing in an electrophotographic imaging device having either a plurality of movable color photoconductive drums or a plurality of moveable color transfer rolls.

8 Claims, 10 Drawing Sheets

METHOD TO CONTROL TRANSFER OF BLACK AND COLOR TONED IMAGES DURING COMBINED SIMPLEX DUPLEX PRINTING

CROSS REFERENCES TO RELATED APPLICATIONS

The present application is related to U.S. patent application Ser. No. 15/395,627, entitled "METHOD TO CONTROL TRANSFER OF BLACK AND COLOR TONED IMAGES DURING SIMPLEX PRINTING", filed Dec. 30, 2016 and to U.S. patent application Ser. No. 15/592,537 entitled "METHOD TO CONTROL TRANSFER OF BLACK AND COLOR TONED IMAGES DURING DUPLEX PRINTING", filed May 11, 2017, both assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to electrophotographic imaging devices such as a printer or multifunction device having printing capability, and in particular to methods for controlling the transfer of toned black and color images during simplex printing.

2. Description of the Related Art

Color imaging devices contain two or more cartridges, each of which transfers a different color of toner to a media sheet as required to produce a full color copy of a toner image. A common imaging device includes four separate color cartridges—cyan, yellow, magenta, and black. Image formation for each of the four colors includes moving toner from a reservoir to an imaging unit where toned images, black or color are formed on photoconductive (PC) drums prior to transfer directly to a media sheet or to an intermediate transfer member (ITM) belt for subsequent transfer to a media sheet.

A first image is formed on the ITM belt and transferred to the media, then color transfer rolls are engaged or disengaged with the ITM belt to prepare for the next image. If the color transfer rolls are moved before the previous image is transferred to the media, the previous image may be disturbed due to the belt movement causing a print quality defect. So a large inter-page gap is required for each transition between black-only and color printing A duplex media handling system typically supports two (or more) media sheets in the media path at the same time. When two sheets are in the path, a loop is formed in which a large inter-page gap cannot be introduced without causing the sheets to collide. Therefor in order to make any transition between black-only and color printing, the media path is emptied, the color process transition occurs, and printing resumes. This causes excessive churning of the color toners when frequent transitions occur in some print jobs.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
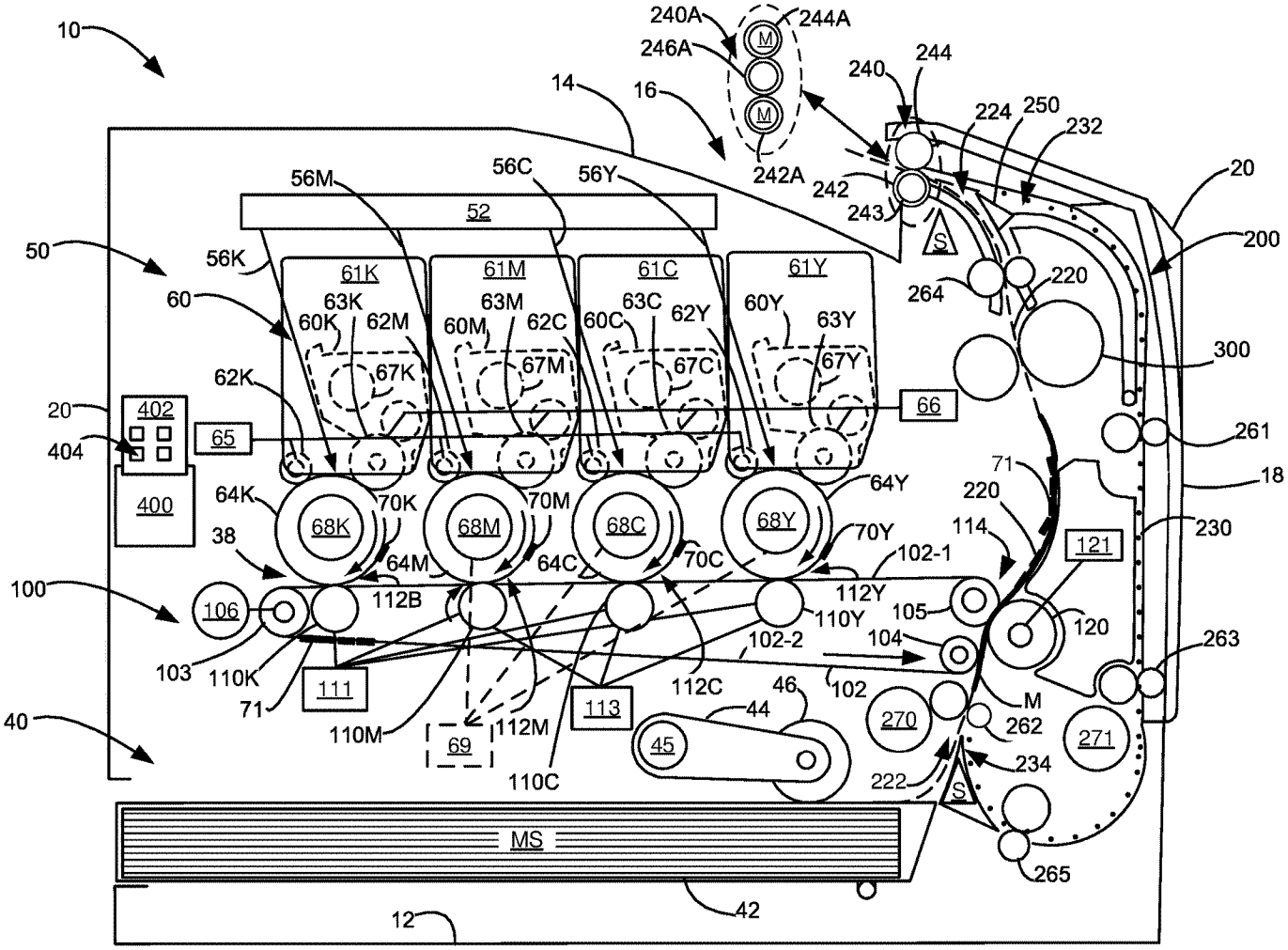
FIG. 1 is a schematic view of an electrophotographic imaging device according to an example embodiment of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including," "comprising," or "having" and variations thereof herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear" and "side" "under", "below", "lower", "over", "upper", and the like, are used for ease of description to explain the positioning of one element relative to a second element as viewed in the accompanying figures. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

The term "media" as used herein encompasses any material for receiving an image. Unless otherwise stated, media is generally rectangular having a top surface or top side and a bottom surface or bottom side. The "leading edge" of a media is the first portion to enter a media feed path. The "trailing edge" of media is the last portion of a media to enter a media feed path. The "side edges" of a media or the "left edge" and "right edge" of a media refer to the edges of the media that are parallel to the media feed path as viewed in the media feed direction. A "margin" is an area of a surface or side of the media beginning at an edge and extending inwardly to a predetermined height or width. A "top margin" extends from the leading edge to a given height. A "bottom margin" extends from the trailing edge to a given height. A side margin extends from a side edge to a given width. Typically as viewed from a media feed direction, a right margin extends from the right edge to a given width and a left margin extends from the left edge. The area of the media bounded by the margins may be termed the "image area" containing text or images to be scanned or to be printed, depending on context.

The term "media transport path" is the route along which media travels in an image forming device and refers to the path from a media input area to a media output area of the image forming device or any portion thereof. The media transport path may have a "simplex portion or path" used when only one side of a media sheet is to be printed and a "duplex portion" that returns a simplex printed media sheet back to the simplex path and through the imaging area to receive a second image on the reverse side thereof. The entrance and exit of the duplex portion are in communication with the exit and entrance of the simplex portion. The term "media feed direction" or "MFD" indicates the direction that media travels within the image forming device or a subassembly thereof.

Unless otherwise indicated "a media feed roll pair" consists of a driven roll and an idler roll that are axially aligned and which form a nip or feed nip therebetween through which media is moved along the media transport path. The driven roll is operably coupled to a drive source in the image forming device and when rotated in one direction will feed a media in the media feed direction and when rotated in an opposite direction may act to block the feeding of media in the media feed direction or feed the media in a direction opposite to the media feed direction.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx.

A controller includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. The controller may be illustrated in the figures as a single entity but it is understood that the controller may be implemented as any number of controllers, microcontrollers and/or processors.

Reference will now be made in detail to the example embodiments, as illustrated in the accompanying drawings. Whenever possible, the same reference numerals will be used throughout the drawings to refer to the same or like parts. Furthermore, and as described in subsequent paragraphs, the specific configurations illustrated in the drawings are intended to exemplify embodiments of the disclosure and that other alternative configurations are possible.

In FIG. 1, there is shown a representative imaging device 10, such as a color electrophotographic printer or laser printer. The imaging device 10 includes a body 12 including a top 14 having a media output area 16 and a front 18. A control panel 20 on front 18 provides information to a user and allows a user to input instructions for the operation of the imaging device 10. Provided imaging device 10 is a media input system 40, an imaging area 50 in which black-only and color toned images are created, an intermediate transfer unit 100 having a rotating intermediate transfer member (ITM) belt used to transfer the toned images to a media sheet, a media transport assembly 200 used for moving a media sheet through imaging device during simplex and duplex printing operations, a fuser assembly 300 used to fuse toned images to the media sheet, and a controller 400 for controlling operation of the imaging device based on user input and programming stored within imaging device 10.

Media input system 40 is provided in a lower region of imaging device 10 and includes a media input source such as a removable media input tray 42 sized to contain a media stack MS having media sheets M to be printed. Imaging device 10 may include more than one media input tray 42. It is understood that media sheets may be fed into media transport assembly 200 from other sources such a manual media tray or from additional media input tray assemblies coupled to imaging device 10. As shown, a pick mechanism 44 having a motor 45 and pick roll 46 is provided above the media stack MS. When motor 45 is driven, pick mechanism 44 using pick roll 46 feeds a top-most media sheet from the media stack MS into media transport assembly 200.

Positioned in an upper region of imaging device 10 is imaging area 50 that includes a laser scan unit 52 and one or more imaging units, generally indicated at 60. Four imaging units 60Y, 60C, 60M and 60K (collectively 60Y-60K) are shown and are used for providing yellow, cyan, magenta, and black toned images to intermediate transfer unit 100. Imaging units 60Y-60K are aligned transversely relative to the direction of rotation of the ITM belt 102 with the yellow imaging unit 60Y being the most upstream, followed by imaging units 60C, 60M, and last, imaging unit 60K being the most downstream along ITM belt 102. Imaging units 60Y-60K include toner reservoirs 61Y, 61C, 61M, 61K, collectively 61Y-61K, having cyan, yellow, magenta, and black toners, respectively. Also provided in toner reservoirs 61Y-61K are toner agitators 67Y, 67C, 67M, 67K, respectively, that are rotated to ensure that the toner particles will flow freely.

Imaging units 60Y-60K include charge rolls 62Y, 62C, 62M, 62K, collectively 62Y-62K, developer rolls 63Y, 63C, 63M, 63K, collectively 63Y-63K, and rotating photoconductive (PC) drums 64Y, 64C, 64M, 64K, collectively 64Y-64K. PC drums 64Y, 64C and 64M are collectively referred to as color PC drums and PC drum 64K is referred to as a black PC drum. Charge rolls 62Y-62K are aligned with and in contact with PC drums 64Y-64K, respectively. Charge rolls 62Y-62K connect to a voltage supply 65 and charge their respective PC drum to a specified voltage, such as −900 volts, for example. Developer rolls 63Y-63K are connected to a voltage supply 66 and are charged to a specified voltage, such as −600 volts for example, and deliver charged toner particles from toner reservoirs 61Y-61K to the outer surfaces of PC drums 64Y-64K, respectively. As explained later, toned images, represented by black blocks 70Y, 70C, 70M, 70K, collectively 70Y-70K, are created on PC drums 64Y-64K by these charged toner particles.

PC drums 64Y-64K are rotated by drum motors 68Y, 68C, 68M, 68K, collectively 68Y-68K. Drum motors 68Y, 68C, 68M may be collectively referred to as color drum motors 68Y-68K while drum motor 68K may be referred to as a black drum motor 68K. While separate motors are shown for color PC drums 64Y-64M, as is known in the art a single color motor and appropriate gear train may be used. Also as is known in the art, charge rolls 62K-62Y, developer rolls 63Y-63K, and toner agitators 67Y-67K, may be coupled through respective gearing to drum motors 68Y-68K in order to be rotated.

In an example embodiment, the ITU 100 comprises an ITM belt 102 formed as an endless loop trained about a plurality of support rolls 103-105 positioned in a triangular arrangement. A motor 106 is used to drive one of the support rolls 103-105, roll 103 as shown, to rotate ITM belt 102 in a counter clockwise direction as shown in FIG. 1.

A plurality of electrically charged transfer rolls are provided in the interior of the loop formed by ITM belt 102. A transfer roll is provided for each PC drum. Transfer rolls 110Y, 110C, 110M, 110K, collectively 110Y-110K, are aligned with PC drums 64Y-64K, respectively. Transfer rolls 110Y-110K are connected to power supply 111 that applies a voltage to each transfer roll that is opposite (e.g. more positive) to the charge on the toned images 70Y-70K present on respective PC drums 64Y-64K. Transfer rolls 110Y-110K are aligned with PC drums 64Y-64K, respectively, and form first transfer nips 112Y, 112C, 112M, 112K, respectively. Transfer rolls 110Y, 110C, 110M are collectively referred to as the color transfer rolls. Transfer roll 110K is also referred to as the black transfer roll. Similarly first transfer nips 112Y, 112C, 112M are referred to as the color transfer nips and first transfer nip 112K is also referred to as the black transfer nip. Transfer rolls 110Y-110K are rotated by ITM belt 102.

Figure 2A:
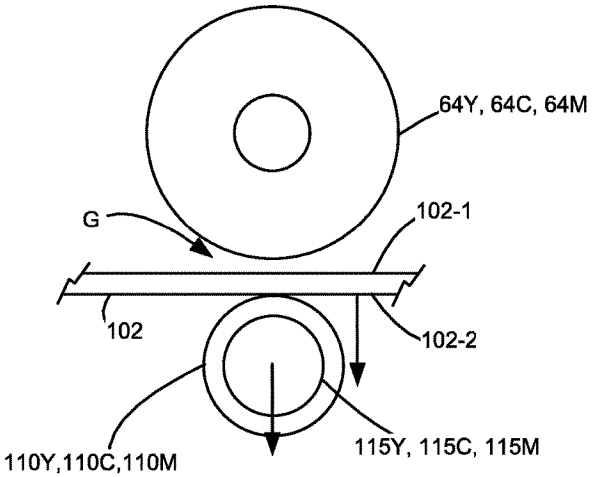
FIGS. 2A-2B schematically illustrate the disengaged and engaged position of the color transfer rolls for the imaging device of FIG. 1.
Figure 2B:
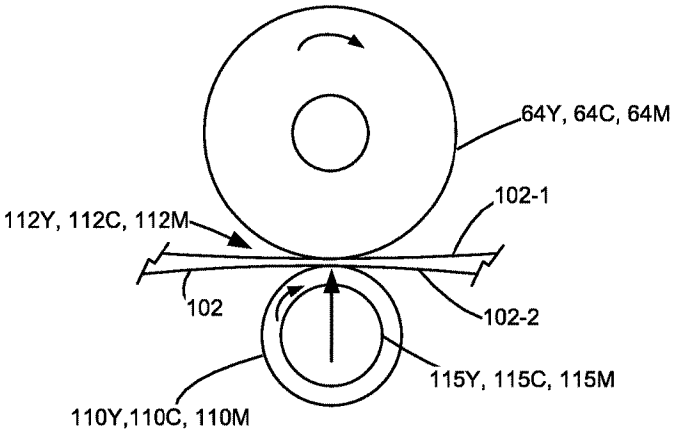

Color transfer rolls 110Y-110M are coupled to a retraction mechanism 113 which is used to move them between a disengaged position and an engaged position with respect to their respective color PC drum. The disengaged position of the color transfer rolls 110Y-110M is shown in FIG. 2A. A gap G is created between ITM belt 102 and each of the color PC drums as the color transfer rolls 110Y-110M are disengaged and retracted or moved away from their respective color PC drum. The ITM belt 102 follows the movement of the color transfer rolls 110Y-110M as they move away from the color PC drums 64Y-64M. In the engaged position, shown in FIG. 2B, the color transfer rolls 110Y-110M are moved by retraction mechanism 113 back toward their respective color PC drums. ITM belt 102 is pressed or pinched by the color transfer rolls 110Y-110M against their respective color PC drums, as indicated by the exaggerated bending of the outer and inner surfaces 102-1, 102-2 of ITM belt 102. First transfer nips 112Y, 112C, 112M are reformed. First transfer nips 112Y, 112C, 112M are also referred to the color transfer nips while first transfer nip 112K is referred to as the black transfer nip. Black transfer roll 110K is not coupled to retraction mechanism 113 and remains in an engaged position with respect to the black PC drum 64K and ITM belt 102 during all printing operations. This is done because black toner will be used in almost every image that will be printed. While a single retraction mechanism is shown, it will be understood an individual retraction mechanism may be provided for each of the color transfer rolls 110Y-110M.

In an alternate embodiment and in lieu of using retraction mechanism 113 to move the color transfer rolls 110Y-110M from their respective engaged positions to their respective disengaged positions, color PC drums 64Y-64M are coupled to a retraction mechanism 69 which is used to move them between their disengaged positions and their engaged positions with respect to their respective color transfer roll and ITM belt 102. Typically, when the color PC drums 64Y-64M are retractable, the color transfer rolls would be positioned against ITM belt 102 and retraction mechanism 113 would not be needed. However, both retraction mechanisms may be used. The disengaged position of the color PC drums 64Y-

Figure 2C:
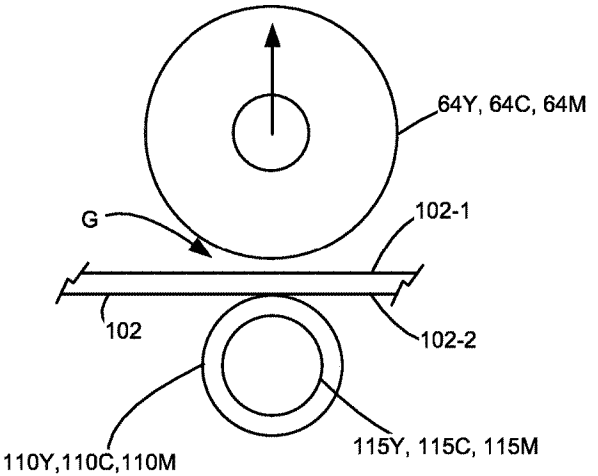
FIGS. 2C-2D schematically illustrate an alternate embodiment showing the disengaged and engaged position of the color PC drums for the imaging device of FIG. 1.
Figure 2D:
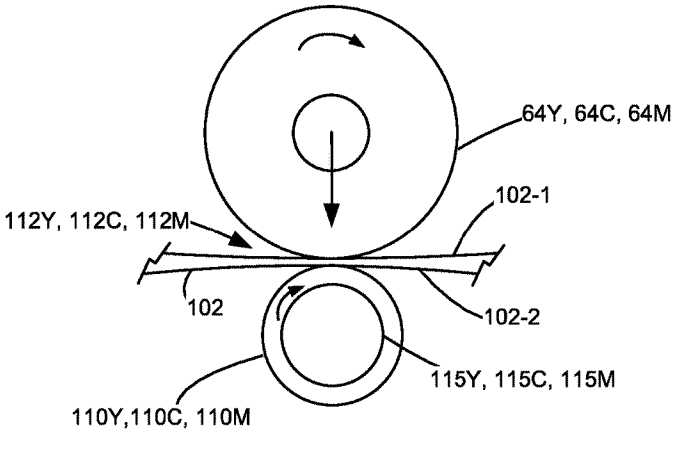

64M is shown in FIG. 2C. Gap G is created between ITM belt 102 and each of the color PC drums as the color PC drums 64Y-64M are disengaged and retracted or moved away from their respective color transfer roll and the ITM belt 102. In the engaged position, shown in FIG. 2D, the color PC drums 64Y-64M are moved by retraction mechanism 69 back toward their respective color transfer rolls. ITM belt 102 is pressed or pinched between the color transfer rolls 110Y-110M and their respective color PC drums 64Y-64M, as indicated by the exaggerated bending of the outer and inner surfaces 102-1, 102-2 of ITM belt 102. First transfer nips 112Y, 112C, 112M are reformed. While a single retraction mechanism 69 is shown, it will be understood an individual retraction mechanism may be provided for each of the color PC drums 64Y-64M.

Media transport assembly 200 is provided adjacent to media input system 40, imaging area 50 and ITU 100, and includes a media transport path 210, a media redrive system 240, a diverter gate 250, a plurality of media feed roll pairs 261-265 spaced about transport path 210, and feed roll drive motors 270, 271. Media transport path 210 extends from media input tray 42 to media output area 16. Media transport path 210 has a simplex portion 220 with a generally S-shaped configuration indicated by the dashed line and a duplex portion 230 with a generally reversed C-shaped configuration, indicated by the dotted line. Simplex portion 220 has an entrance 222 adjacent media input tray 42, an exit 224 adjacent media output area 16 and courses past ITU 100, through fuser assembly 300 to media redrive system 240. Duplex portion 230 has an entrance 232 and an exit 234 adjacent to exit 224 and entrance 222, respectively, of simplex portion 220. Media diverter gate is positioned at the exit 224 of simplex portion 220 and the entrance 232 of duplex portion 230. As is known, media position sensors S are provided at multiple locations of media transport path 210 to detect the leading and trailing edges of a media sheet as it passes along long media transport path 210 such as when exiting media input tray 42 and exiting simplex portion 220.

Feed roll pairs 262 and 264 are provided upstream and downstream of image transfer roll 120 on simplex portion 220. Feed roll pair 262 receives a media sheet from media input tray 47 or from the output 234 of duplex portion 230 and feeds it to image transfer roll 120. Feed roll pair 264 receives the printed media sheet from image transfer roll 120 and feed it to media redrive system 240. Feed roll pairs 261, 263, 265 are provided on duplex portion 230. Feed roll pair 261 receives media from media redrive system 240 and feeds it to feed roll pair 263 that in turn feeds it to feed roll pair 265 that is positioned adjacent to the exit 234 of duplex portion 230. Feed roll drive motor 270 is coupled to and drives the feed roll pairs 262, 262 while feed roll drive motor 271 drives feed roll pairs 261, 263, 265. Using the two feed roll drive motors 270, 271 allows controller 400 to independently control the movement of media sheets in the simplex and duplex portions 220, 230 to create the inter-page gaps between media sheets in a print job as discussed herein. Alternatively a single feed roll motor and clutch system may be used to drive feed roll pairs 262, 264 and feed roll pairs 261, 263, 265 to control movement of media sheets in the simplex and duplex portions 220, 230. The communication links between controller 400 and feed roll drive motors 270, 271 and the couplings between drive motors 270, 271 to their respective feed roll pairs are not shown for purposes of clarity in FIG. 2.

Media redrive system 240 is used to either feed a printed media sheet out into media storage area 16 or back in duplex portion 230 to be returned into simplex portion 220 to receive an image on its the reverse side. Media redrive system 240 may be a two roll or a three roll system. Media redrive system 240 as shown has two exit rolls 242, 244 with exit roll 242 having a drive motor 243. A three roll media redrive system 240A system is shown in the inset having three rolls 242A, 244A, 246A forming two feed nips where the two outboard rolls 242A, 244A each have a drive motor M. Operation of either a two or three roll media redrive system during simplex and duplex printing operations is well known in the art. Media redrive system 240 may also be termed a peek-a-boo duplexer. As is known three roll media redrive system 240A can process two media sheets by simultaneously feeding one media sheet out into media storage area 16 while feeding a second media back into duplex portion 230. Diverter gate 250 on one position allows a media to enter media redrive system 240 from simplex path 220. In a second position, diverter gate 250 allows a media sheet held in media redrive system 240 to be directed into entrance 232 of duplex portion 230.

Fuser assembly 300 is provided upstream of ITU 100 on simplex portion 220 near diverter gate 250 for fusing the transferred toner image 71 onto a surface of the media sheet M. Fuser assembly 300 may be a belt fuser or a hot roll fuser as is known in the art.

During a printing operation, controller 400 receives a print job containing print data representing one or more black images and/or one are more color images. Using stored programs, controller 400 formats the print data into one of the four colors and rasterizes it into one of four color data streams that are sent to the laser scan unit 52 which produces four laser beams, 56Y, 56C, 56M, 56K, collectively 56Y-56K, one for each color. It will be understood that not all colors will be present in a given image of a print job. Laser beams 56Y-56K contact the respective surfaces of the electrically charged rotating PC drums 64Y-64K discharging those areas contacted to form latent images, writing one laser scan line at a time. In one embodiment, areas on the PC drums 64Y-64K illuminated by the laser beams 56Y-56K are discharged to approximately −300 volts. Because developer rolls 63Y-63K are biased to about −600 volts the negatively charged toner particles provided by the developer rolls 63Y-63K are attracted to the more positively charged latent image areas on their respective PC drums 64K-64Y forming toned images in each of the colors Y, C, M, B. The process of writing scan lines, toning them, forming toned black and color images and transferring them to the rotating ITM belt 102 of ITU 100 is done continuously until the images have been completed and subsequently transferred to a media sheet in the transport path 210.

During image forming operations, the charge on each of the transfer rolls 110Y-110K causes the toned images 70Y-70K on the respective PC drums 64Y-64K to transfer to the outer surface 102-1 of ITM belt 102 as it passes through the first transfer nips 112Y-112K. For mono-color images, a toned image is applied from a single imaging unit 60, such as black imaging unit 60K or cyan imaging unit 60C for example. However, the majority of mono-color images are black. For color images, toned images are applied from two or more imaging units 60 such as imaging units 60Y, 60M and 60K. The transferred toner image 71 may be formed of a single toner. When only black toner is used, toner image 71 may be referred to as black toned image or black only toned image or as a mono-toned image when only one of the colored toners other than black toner is used. The toner image 71 may also be a combination of two or more of the toners laid on top of another and be referred to as a color toned image. For example, toned image 70C may be placed, in whole or in part, on top of toned image 70Y. Toned image 70M may be placed, in whole or in part on top of the combined toned images 70Y, 70M or on just toned image 70Y, and similarly for the black toned image 70K and any one or all. Once past imaging unit 60K, that portion of the toned image is complete and ready to be transferred onto the media sheet.

The transferred toned image, as indicated at 71, is carried by ITM belt 102 to an image transfer nip 114 formed between support roll 105 and an electrically charged image transfer roll 120. Image transfer roll 120 is connected to power supply 121. Image transfer roll 120 is charged to a voltage that is more positive than that of the transferred toned image 71. As a media sheet M passes through image transfer nip 114, the toned image 71 is transferred to a first surface of media sheet M. Media sheet M is then conveyed along simplex portion 220 to fuser assembly 300 where the toned image 71 is fused onto media sheet M. Next media sheet M is feed to redrive system 240 where it is either output to media output area 16 or feed past diverter gate 250 into duplex portion 230 to be returned to image transfer nip 114 to receive a new toned image on its reverse or second surface.

In another embodiment, the media sheet to be printed is directed onto the outer surface 102-1 of ITM belt 102 and through first transfer nips 112Y-112K to directly receive the transferred black and color toned images. The media sheet is then passed through fuser assembly 300 rather than going through image transfer area 114.

Controller 400 and associated memory 402 containing programming 404 controls the operation of the imaging device 10 including image formation, PC drum charging, color transfer roll engagement/disengagement as well as the present methods set forth in this disclosure. Power supplies 65, 66, 111, 121, motors 45, 68Y, 68C, 68M, 68K, 106, 243, 270, retraction mechanism 113, media redrive system 240, diverter gate 250, fuser assembly 300, and media position sensors S are all in operative communication with controller 400 via communication links. These communication links are not shown for purposes of clarity as the structure and use of such communication links are well known in the art.

Figure 3:
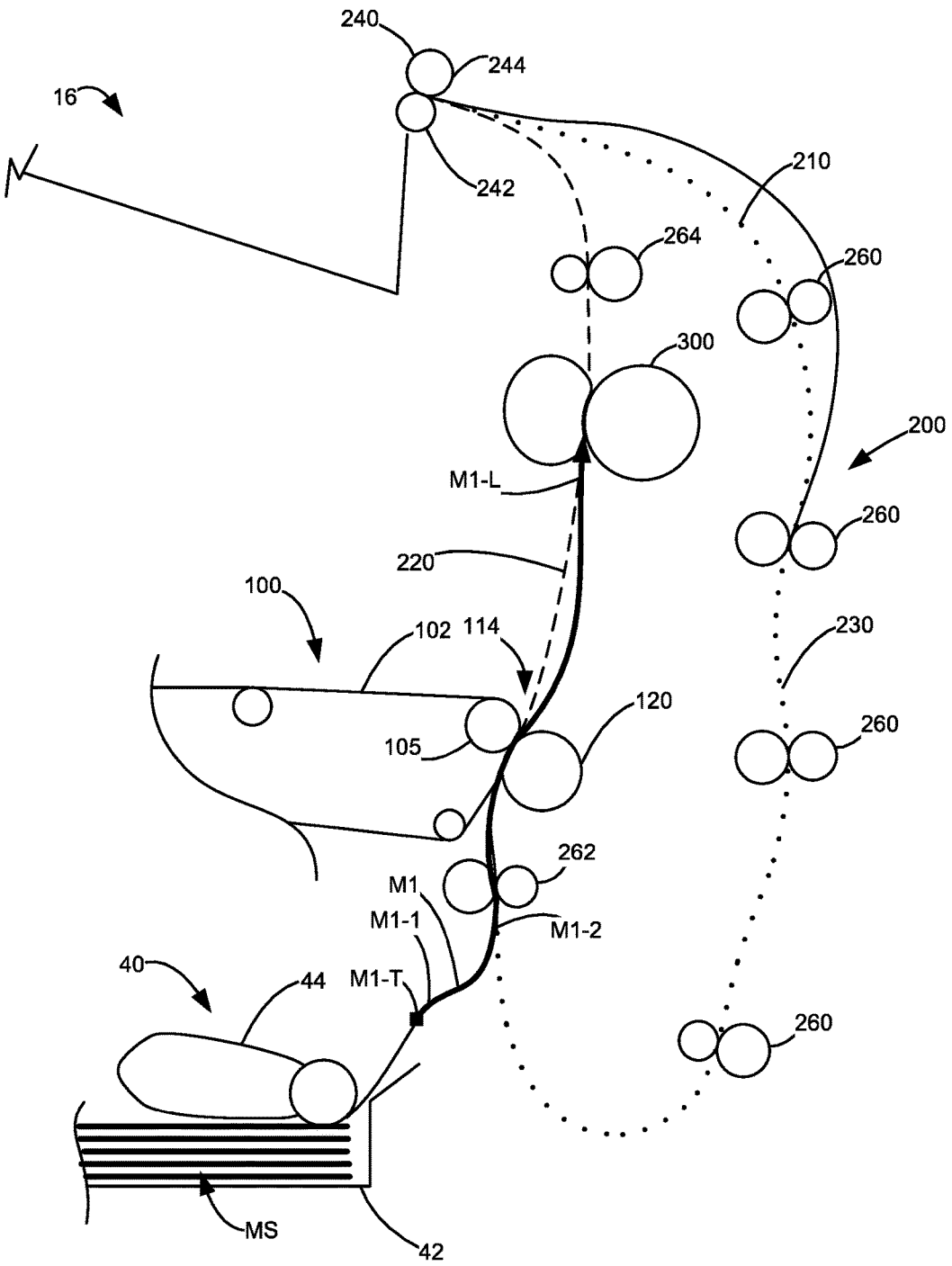
FIG. 3 shows a schematic view of a media transport path of the imaging device of FIG. 1 according to an example embodiment, showing a simplex printing operation.
Figure 4:
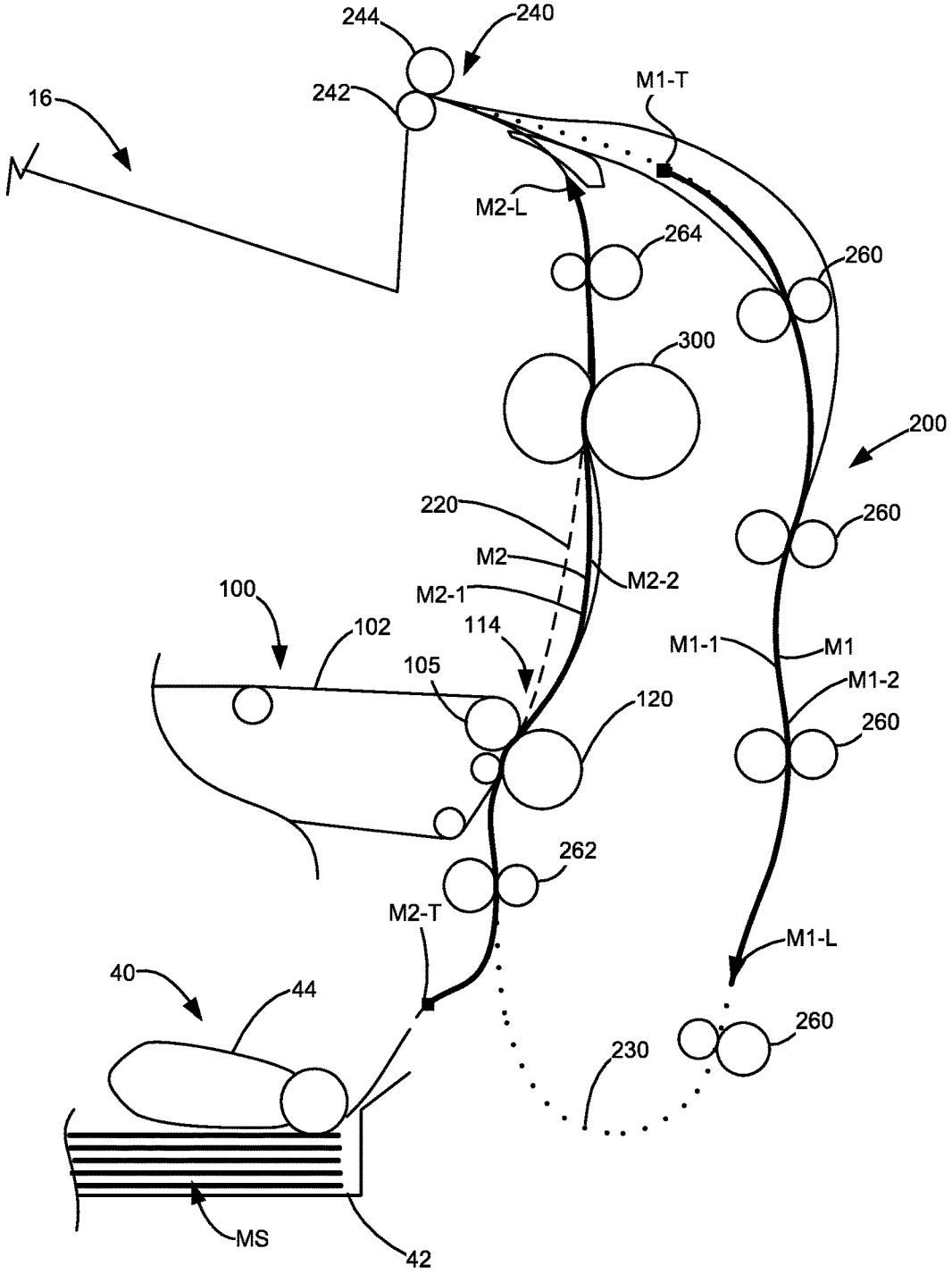
FIGS. 4-5 show the media transport path of FIG. 3 and a duplex printing operation where FIG. 4 show a first media sheet having a first image on a first side retracted towards a duplex media path and a second media sheet receiving a second image on a first side as it moves through a simplex media path and FIG. 5 shows the first media sheet reentering the simplex media path from duplex media path to receive a third image on the reverse side while and the second media sheet moved into the duplex media path.
Figure 5:
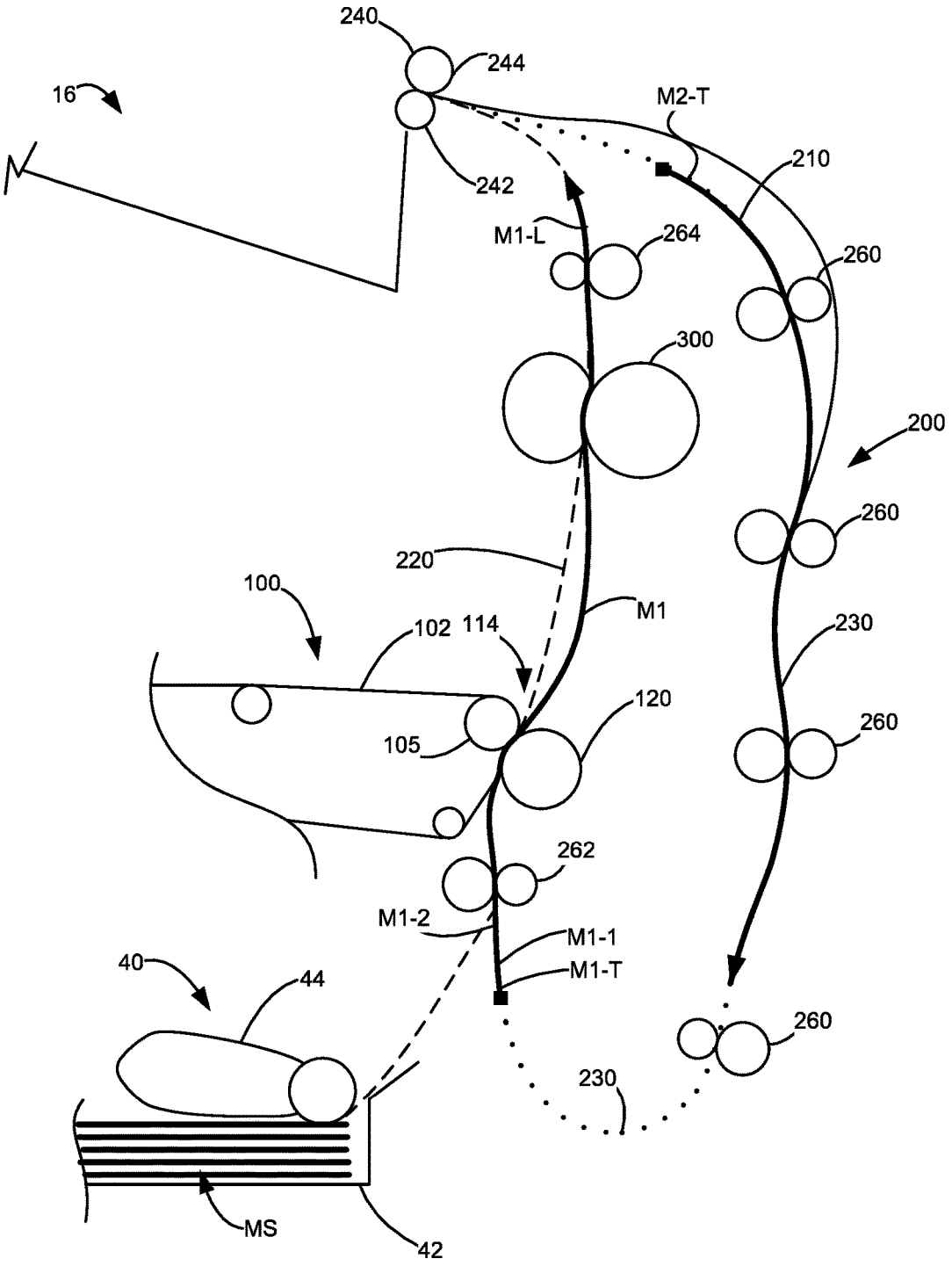

FIGS. 3-5 shows schematic view of media transport system 200 including media transport path 210 and with simplex and duplex portions 220, 230 and the movement of media sheets during simplex and duplex printing operations. In these figures the media sheets are shown being fed from the media stack MS in media input tray 42, however it is understood that media sheets may be fed into media transport path from other media input sources such a manual media tray or from additional media input tray assemblies coupled to imaging device 10.

In FIG. 3, media sheet M1 has first and second sides M1-1, M1-2, leading and trailing edges M1-L, M1-T, respectively. Sheet M1 has travelled from the media input tray 42 through media feed roll pair 262 where any skew in the leading edge M1-L of media sheet M1 is removed, past image transfer area 114 where color or black toned images are transferred to first surface M1-1. Leading edge M1-L has reached fuser assembly 300. As media sheet M1 passes through fuser assembly 300, color and/or black toned images are fused to the first surface M1-1. At media feed roll pair 264 downstream of fuser assembly 300, media sheet M1 is decurled and driven towards media redrive system 240.

For the two roll media redrive system 240, rolls 242, 244 may be rotated in either direction. When driven in a first direction, media sheet M1 is fed from the simplex portion 220 toward media output area 16. For duplex printing using a peek-a-boo system, as the trailing edge M1-T of media sheet M1 nears exit rolls 242, 244, their rotational direction is reversed moving media sheet M1 into duplex portion 230. When duplexing occurs, media sheet M1 is returned to image transfer area 114 where the second side M1-2 of media sheet M1 receives the new toned image. The new toned image is fused onto second side M1-2 and media sheet M is fed by media redrive system 240 into the media output area 16.

In one example embodiment, each of the following mechanisms is driven by an independent motor: pick mechanism 44, media feed roll pair 262, ITU 100, each of the PC drums 68Y-68K and media redrive system 240. Each of the media feed rolls 260 may share a common motor, and fuser assembly 300 and media feed roll pair 264 may share a common motor. The above configuration allows the highest duplex throughput for systems with a two roll media redrive system that cannot handle two media sheets at the same time FIGS. 4-5 illustrate a duplexing operation having two media sheets in the media transport path 210. With reference to FIG. 4, first media sheet M1 has been fed from media redrive system 240 shown in the duplex portion 230 with its first side printed M1-1. On entering the duplex portion 230, the leading and trailing edges of media sheet M1 are reversed with the former trailing edge becoming leading edge M1-L and forming leading edge becoming trailing edge M1-T. A second media sheet M2, having first and second sides M2-1, M2-2, and leading and trailing edges M2-L, M2-T, had been fed from media input tray 42 through image transfer area 114, where a second image has been transferred onto first surface M2-1, and fuser assembly 300 towards media redrive system 240. When the first surface M2-1 of the second media sheet M2 has been printed and to be driven into redrive system 240 and out towards the media output area 16, a first inter-page gap between media sheets M1 and M2 must occur. The now trailing edge M1-T of the first media sheet M1 as it is fed into duplex portion 230 must clear media redrive system 240 and leave time for media redrive system 240 to change direction before the leading edge M2-L of the second media sheet M2 reaches media redrive system 240. As a result, a first inter-page gap in a duplex printing operation is much larger than an inter-page gap when first media sheet M1 has undergone only a simplex printing operation as first media sheet M1 would be continue to be fed in the same direction and directly out into media output area 16.

Referring to FIG. 5, the second media sheet 125 has been driven by media redrive system 240 into duplex portion 230 46 and first media sheet M1 has reentered simplex portion 220. Second side M1-2 of first media sheet M1 receives a third image as it passes image transfer area 114. Leading edge M1-L is shown ready to enter media redrive system 240. A second inter-page gap is defined between the trailing edge M2-T of the second media sheet M2 and the leading edge M1-L of the first media sheet M1, such that these edges are positioned about the same distance from media redrive system 240. The second inter-page gap is usually greater than the first inter-page gap, as the media feed roll pairs 260 in the duplex portion 230 do not run at a speed faster than the process speed while the first media sheet M1 is still transferring from the duplex portion 230 and into simplex portion 220. Further, the second inter-page gap cannot be extended to allow transitions between black-only and color printing as the media sheet being moved into duplex portion 230 will run into the other media sheet already in the duplex portion 230. As a result of this gap, the motor of media feed roll pairs 260 speeds up such that the trailing edge M2-T of second media sheet M2 clears media redrive system 240 as soon as trailing edge M1-T of the first media sheet M1 exits duplex portion 230. Because first media sheet M1 is transported into media output area 16 after printing second side M1-2, the feeding speed of second media sheet M2 through duplex portion 230 may be increased to reduce the inter-page gap between leading edge M2-L of second media sheet M2 and trailing edge M1-T of first media sheet M1.

In the present invention, there are three printing modes during a print operation—color, retracted, and paused. In the color mode, a color image is being transferred and each of the transfer rolls 110Y-110K are in their respective engaged positions with PC drums 64Y-64K, respectively, and the drum motors 68Y-68K are engaged such that each of the PC drums 64Y-64K are rotated to transfer color toned images and black toned image onto ITM belt 102.

In the retracted mode, rotation of the color PC drums 64Y-64M is stopped by turning off drum motors 68Y-68M and the color transfer rolls are moved to their respective disengaged positions that are retracted from their respective color PC drum allowing ITM belt 102 to separate from the color PC drums.

In the paused mode, rotation of the color PC drums 64Y-64M is stopped by turning off the color drum motors 68Y-68M and the color transfer rolls are left in their engaged position. In this mode, ITM belt slides against the stationary color PC drums 64Y-64M, which generates a small tribo-electric charge on their surfaces. If this tribo-electric charge is left for a long period of time on the photoconductor surfaces, the tribo-electric charge can penetrate the photoconductor surfaces, causing a print quality defect. The charge is removed by turning on color drum motors 68Y-68M and rotating the color PC drums 64Y-64M the distance from the transfer nips 112Y-112M to the nip formed at the charge rolls 62Y-62M while recharging the surfaces of color PC drums 64Y-64M using the charge rolls 62Y-62M.

FIGS. 6-10 are flowcharts of a combined simplex and duplex printing method M10, and printing routines—a load routine R10, a full routine R20, an empty routine R30, and a shutdown routine R40. The terms "image" and "page" in the description of these methods and routines are used interchangeably.

Figure 6:
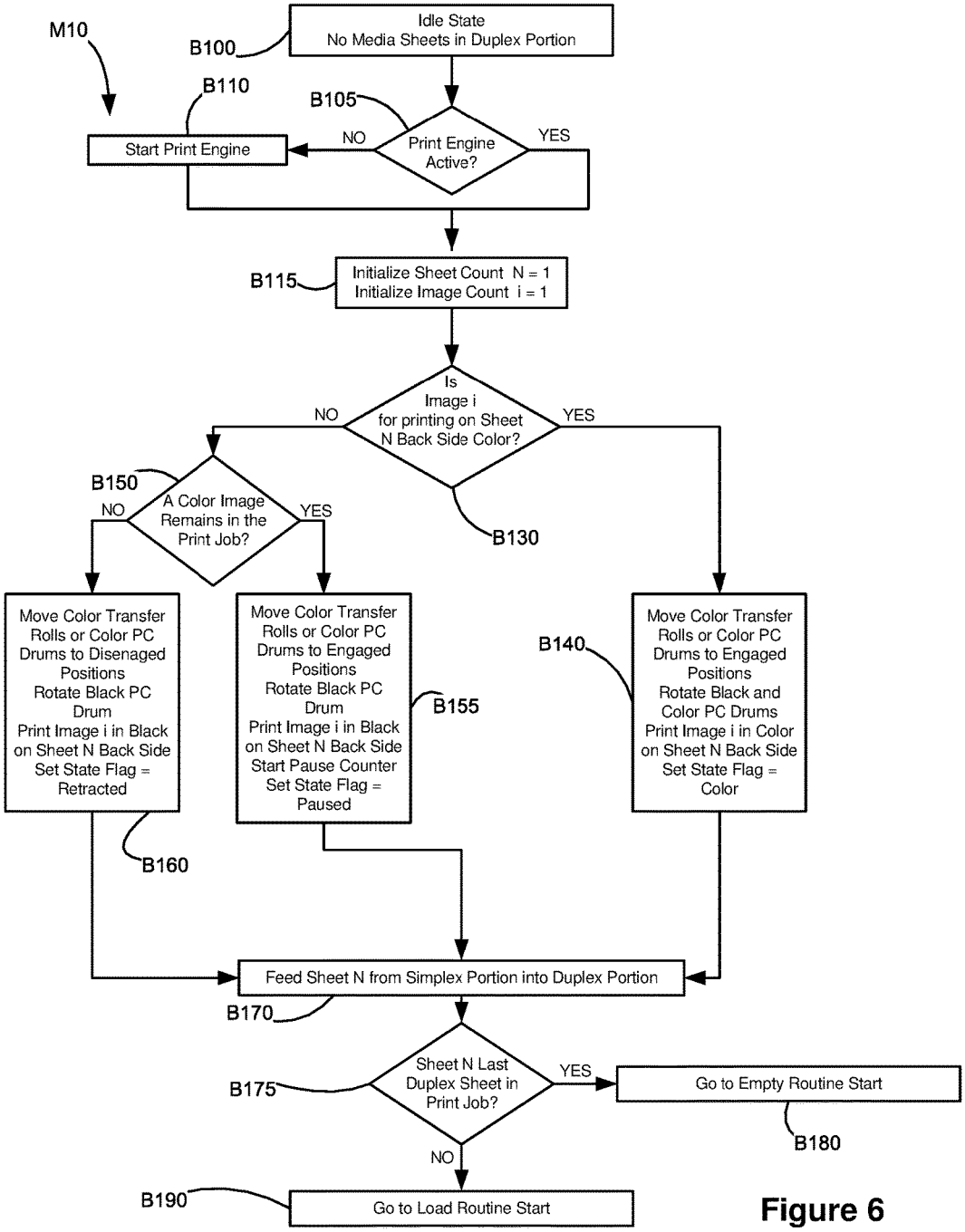
FIG. 6 is a flowchart showing a method of starting duplex printing of color and black only images, which gets the first media sheet into the duplex path.

With reference to FIG. 6, the method M10 starts at block B100 with the imaging device 10 being in an idle state prior to the beginning a combined simplex and duplex print job. Such a print job has some media sheets requiring printing on both sides—a duplex sheet and some media sheets requiring printing only on one side—a simplex sheet. When in the idle state, no media sheets are in the duplex portion 230. The print engine may be idling with no printing occurring or the print engine may be performing a simplex print job. As previously stated the black transfer roll 110K and black PC drum 64K remain engaged. Controller 400 receives a combined simplex duplex print job containing pages to be printed with each page containing either a black-only image or a color image. At block B105, a determination is made whether or not the print engine is active. When the print engine is not active, at block B110 the print engine is started and method M10 proceeds to block B115. When the print engine is active, method M10 proceeds to block B115. At block B115 the media sheet count N and the image count i are initialized. For example media set count N is set one and image count i is set to one. Next, at block B130, a determination is made whether or not image i for printing on the back side of media sheet N is a color image.

When it is determined at block B130 that image i is a color image, method M10 proceeds to block B140 where the color transfer rolls 110Y-110M are moved to their respective engaged positions or alternatively, at block B140, the color PC drums 64Y-64M are moved to their respective engaged positions. Also, the black and color PC drums 64K and 64Y-64M are rotated, the image i is printed on the back side of the media sheet N in color and the state flag is set to Color. The state flag has one of three statuses—Color, Retracted, or Paused.

When it is determined at block B130 that image i is not a color image, i.e., that image i is a black only image, method M10 proceeds to block B150 where a determination is made whether or not a color image remains to be printed in the print job.

When is it determined at block B150 that a color image remains to be printed in the print job, then at block B155, the color transfer rolls 110Y-110M are moved to their respective engaged positions. Also at block B155, the black PC drum 64K is rotated, the image i is printed in black on the back side of the media sheet N, a pause counter is started, and the state flag is set to Paused. Alternatively, at block B155, the color PC drums 64Y-64M are moved to their respective engaged positions.

The pause counter in one embodiment counts down from a predetermined value empirically based on process speed. The amount of built up tribo-electric charge varies with process speed and at faster process speeds the color PC drums 64Y-64M have to be recharged in a shorter amount of time. Example pause time periods for process speeds of 20, 30, 40 and 50 ppm are approximately 60, 50, 40, and 30 seconds, respectively. At higher process speeds, a larger tribo charge is built up, so a shorter pause time is needed.

When it is determined at block B150 that a color image does not remain to be printed in the print job, then at block B160, the color transfer rolls 110Y-110M are moved to their respective disengaged positions. Also at block B160, the black PC drum 64K is rotated, the image i is printed in black on the back side of the media sheet N, and the state flag is set to Retracted. Alternatively, at block B160, the color PC drums 64Y-64M are moved to their respective disengaged positions.

After blocks B140, B155, and B160, at block B170, the media sheet N is fed from the duplex portion 220 into the duplex portion 230. Next, at block B175, a determination is made whether or not the media sheet N is the last duplex sheet in the print job. When it is determined that media sheet N is the last media sheet in the print job, method M10 proceeds to block B180 and enters the empty routine R30. When it is determined that media sheet N is not the last media sheet in the print job, method M10 proceeds to block B185 and enters the load routine R10. At this point, the media sheet N is in the duplex portion 230.

Figure 7:
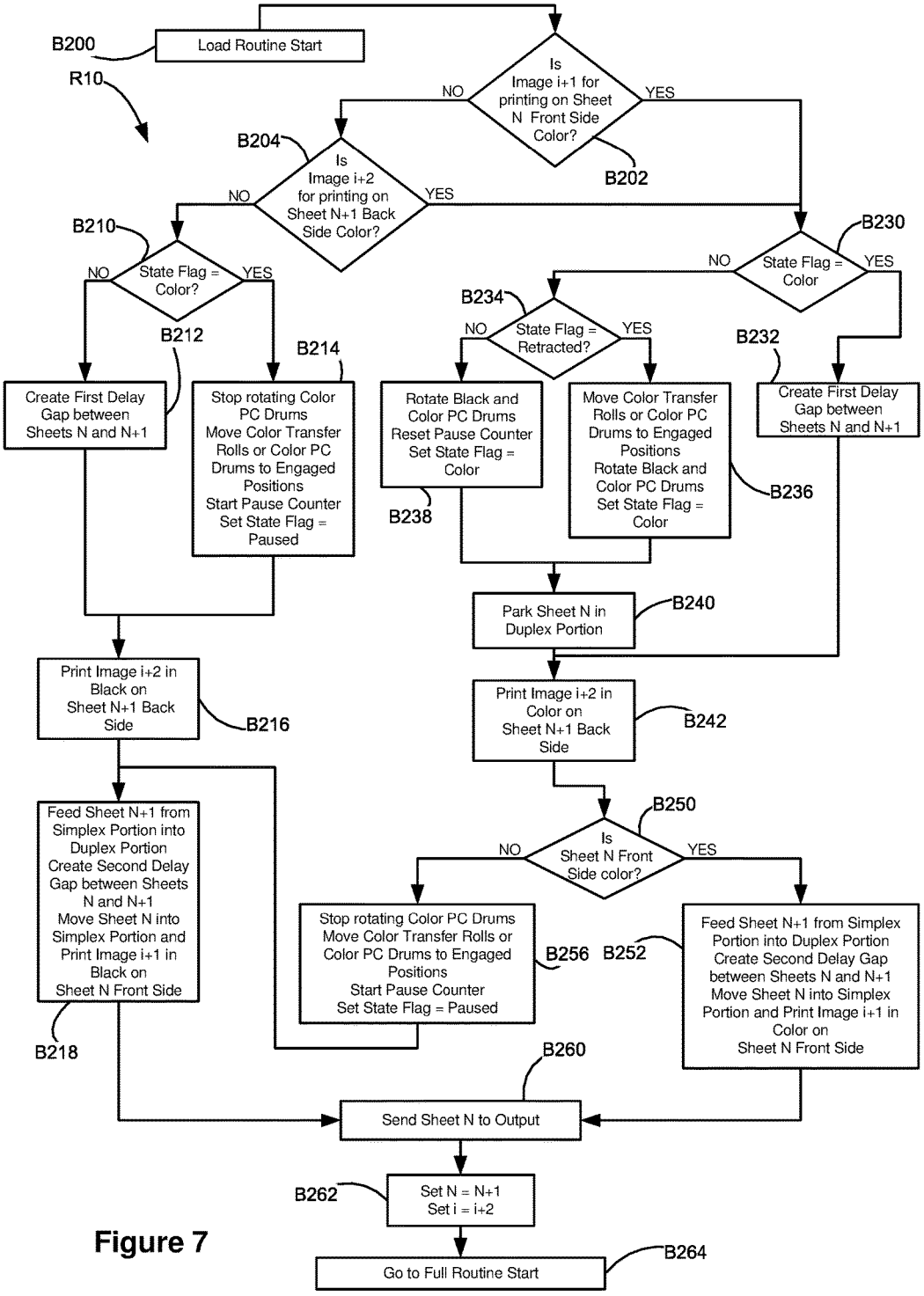
FIG. 7 is a flowchart showing a method of loading a duplex path in duplex printing of color and black only images, which moves the first media sheet through the duplex path and a second media sheet into the simplex path.

With reference to FIG. 7, load routine R10 begins at block B200. At block B202 a determination is made whether or not an image i+1 for printing on the front side of media sheet N is a color image. When it is determined at block B202 that the image i+1 is a color image, routine R10 proceeds to block B230. When it is determined at block B202 that the image i+1 is not a color image, routine R10 proceeds to block B204. At block B204, a determination is made whether or not an image i+2 for printing on a back side of media sheet N+1 is a color image. When it is determined at one of block B202 and B202, that one of that the image i+1 for printing on the front side of the media sheet N is a color image and that the image i+2 is a color image, then, at block B230, a determination whether or not the state flag is set to Color is made. Upon determining that the state flag is set to Color at block B230, at block B232, a first delay gap is created between a leading edge of the media sheet N and a trailing edge of a media sheet N+1. Thereafter, routine R10 proceeds to block B242.

The first delay gap is created by delaying the pick of the media sheet N+1 from the input stack MS while media sheet N is fed through the simplex portion 220. The delay gap is defined such that the media sheet N will be completely within the duplex portion 230 when media sheet N+1 reaches output rolls 244. The other delay gaps described herein are created in a like manner—delaying either the pick of media sheets from media stack MS, or the feeding of media sheets from the duplex portion 230. Table 1 shows representative delay gaps values at various process speeds using letter sized media. The magnitudes of the delay gaps are dependent on process speed, media length and the configuration of the media transport path.

TABLE 1

| PROCESS SPEED (PPM) | FIRST DELAY GAP (MM) | SECOND DELAY GAP (MM) | THIRD DELAY GAP (MM) | FOURTH DELAY GAP (MM) | SIMPLEX DELAY GAP (MM) |
|---|---|---|---|---|---|
| 20 | 122 | 125 | 73 | 123 | 43 |
| 25 | 139 | 142 | 83 | 141 | 46 |
| 40 | 192 | 210 | 112 | 194 | 51 |
| 50 | 213 | 232 | 121 | 215 | 58 |

The first delay gap is created between a trailing edge of the media sheet N and a leading edge of the media sheet N+1. The second delay gap is created between a leading edge of the media sheet N and a trailing edge of the media sheet N+1. The third delay gap is created between the leading edge of the media sheet N and a trailing edge of a media sheet N−1. The fourth delay gap is created between the trailing edge of the media sheet N+1 and the leading edge of the media sheet N. The simplex delay gap is created between a leading edge of the media sheet N+1 and a trailing edge of a media sheet N−1.

When it is determined that the state flag is not set to Color as block B230, then at block B234, a determination is made whether or not the state flag is set to Retracted. When it is determined that the state flag is set to Retracted, at blocks B236 and B240, the color transfer rolls 110Y-110M are moved to their respective engaged positions, the black and color PC drums are rotated, the state flag is set to Color and the media sheet N is sent to and held in the duplex portion 230. Alternatively, at block B236, the color PC drums 64Y-64M are moved to their respective engaged positions.

At block B234, when it is determined that the state flag is not set to Retracted, then at blocks B238 and B240, the black and color PC drums, 64K and 64Y-64M, are rotated, the state flag is set to Color, the pause counter is reset and the media sheet N is sent to and held in duplex portion 230. Routine R10 upon reaching block B242, prints image i+2 in color on the back side of the media sheet N+1 that has been fed from the media input tray 42 to the image transfer area 114. Thereafter, at block B250 a determination is made whether or not the front side of the media sheet N is color, i.e., a color image will be printed on the front side of the media sheet N.

Upon determining that the front side of media sheet N is color at block B250, then at blocks B252, B260, B262, the media sheet N+1 is feed from the simplex portion 220 into the duplex portion, a second delay gap between the leading edge of the media sheet N and the trailing edge of the media sheet N+1 is created, the held media sheet N is moved into the simplex portion, the image i+1 is printed on the front side of the media sheet N in color, the held media sheet N is transported into the media output area 16, the media sheet count N is set to N+1 and the image count i is set to i+2. Thereafter, at block B264, the full routine R20 is started.

Upon determining that the front side of media sheet N is not color at block B250, then at block B256, the color PC drums 64Y-64M are stopped rotating, the color transfer rolls 110Y-110M are moved to their respective engaged positions, the pause counter is started and the state flag is set to Paused. Alternatively, at block B256, the color PC drums 64Y-64M are moved to their respective engaged positions. Thereafter, routine R10 proceeds to block B218 where the media sheet N+1 is feed from the simplex portion 220 into the duplex portion 230, the second delay gap is created between the media sheet N and N+1, the media sheet N is transported into the simplex portion 220, and image i+1 is printed in black on the front side of the media sheet N. Next, the media sheet N is sent to the output area 16 at block B260, then at block B262 the media sheet count N is set to N+1 and the image count i is set to i+2. Thereafter, the full routine R20 is started at block B264.

When it is determined at block B204 that image i+2 is not a color image, routine R10 proceeds to block B210 where a determination is made whether or not the state flag is set to Color. When it is determined that the state flag is set to Color, routine R10 proceeds to block B214. At block B214, the rotating color PC drums 64Y-64M are stopped; the color transfer rolls 110Y-110M are moved to their respective engaged positions; the pause counter is started and the state flag is set to Paused. Alternatively, at block B214, the color PC drums 64Y-64M are moved to their respective engaged positions. When it is determined that the state flag is not set to Color, routine R10 proceeds to block B212. At block B212, the first delay gap is created between the leading edge of media sheet N in the duplex portion 230 and the trailing edge of media sheet N+1 in the simplex portion 220 after being fed from media stack MS in media tray 42. After blocks B212 or B214, routine R10 proceeds to block B216

At block B216, the image i+2 is printed in black on the back side of the media sheet N+1 that has been fed from the media input tray 42 to the image transfer area 114. Thereafter routine R10 proceeds to block B218 then to blocks B260, 262, 264, previously described.

Figure 8:
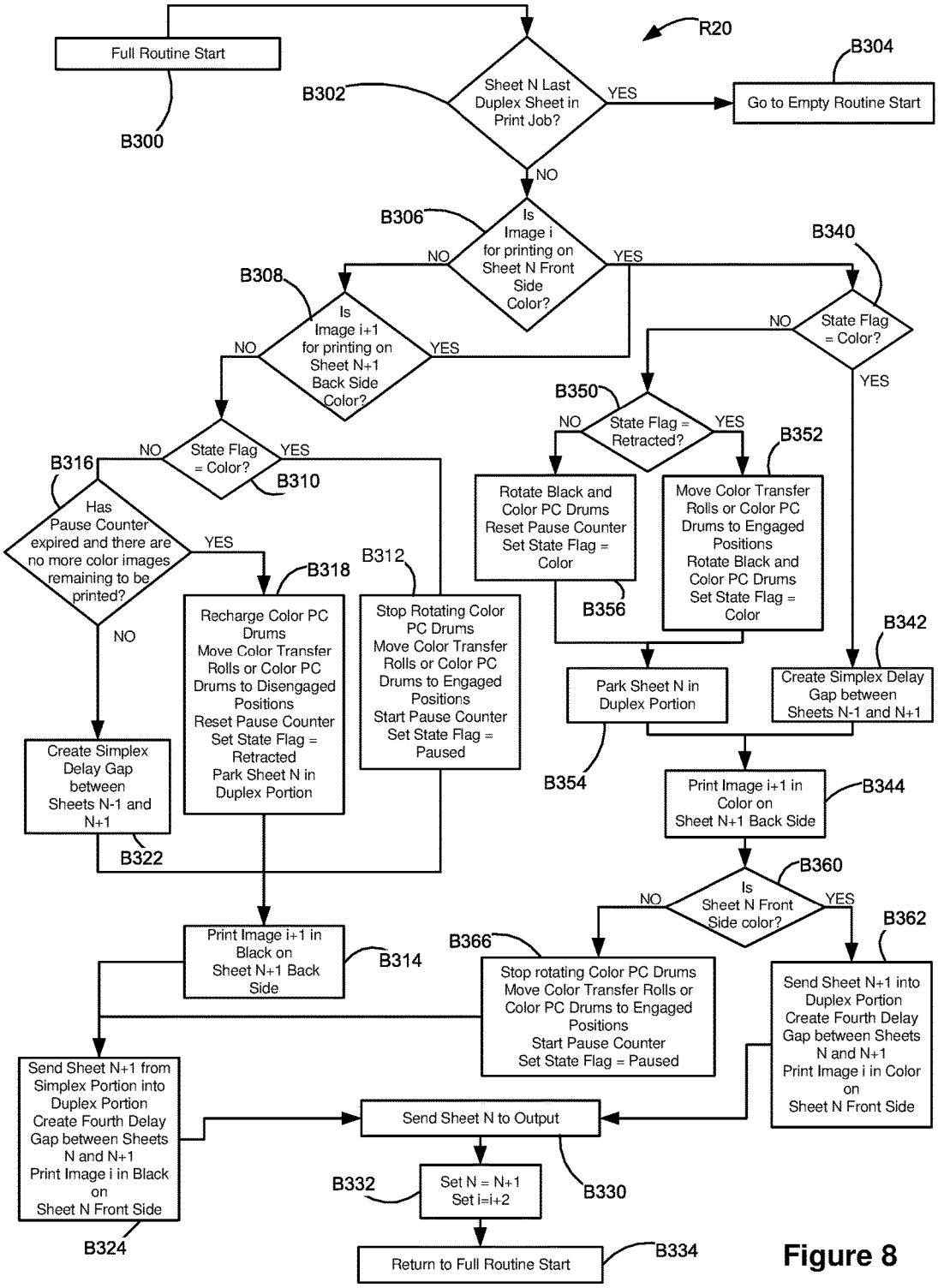
FIG. 8 is a flowchart showing a method of duplex printing of color and black only images while the duplex and simplex portions of the media transport path are full, which moves the first media sheet from the duplex portion back into the simplex portion and into the media output area and moves the second media sheet from the simplex portion into the duplex portion of the media transport path.

With reference to FIG. 8, full routine R20 begins at block B300. At block B302, a determination is made whether or not media sheet N is the last duplex sheet in the print job. When it is determined that media sheet N is the last media sheet in the print job, routine R20 proceeds to block B304 and enters the empty routine R30. When it is determined that media sheet N is not the last media sheet in the print job, routine R20 proceeds to block B306 where a determination is made whether or not image i for printing on the front side of media sheet N is a color image. When it is determined at block B306 that image i is a color image, routine R20 proceeds to block B340. When it is determined at block B306 that image i is not a color image, routine R20 proceeds to block B308. At block B308, a determination is made whether or not an image i+1 for printing on a back side of media sheet N+1 is a color image. When it is determined at block B306 that image i is a color image or when it is determined at block B308, the image i+1 for printing on a back side of media sheet N+1 is a color image, routine R20 proceeds to block B340.

When it is determined at block B308 that image i+1 is not a color image, routine R20 proceeds to block B310 where a determination is made whether or not the state flag is set to Color. When it is determined that the color flag is set to Color, routine R20 proceeds to block B312. At block B312, the rotating color PC drums 64Y-64M are stopped, the color transfer rolls 110Y-110M are moved to their respective engaged positions, the pause counter is started and the state flag is set to paused. Alternatively, at block B312, the color PC drums 64Y-64M are moved to their respective engaged positions. Thereafter routine R20 proceeds to block B314.

When it is determined at block B310 that the state flag is not set to Color, routine R20 proceeds to block B316. At block B316 a determination is made whether or not the pause counter has expired and whether or not there are no more color images to be printed in the print job. When it is determined that one of the Pause Counter has not expired and that there are more color images to be printed, routine R20 proceeds to block B322. At block B322, the simplex delay gap is created between a trailing edge of the media sheet N−1 and the leading edge of the media sheet N+1.

When, at block B316, it is determined that the Pause Counter has expired and that there are no more color images to be printed, routine R20 proceeds to block B318 where the color PC drums 64Y-64M are recharged, then the color transfer rolls 110Y-110M are moved to their respective disengaged positions, the pause counter is rest, the state flag is set to Retracted, and the media sheet N is moved into the duplex portion 230.

Subsequent to one of blocks B312, B318, and B322, routine R20 proceeds to block B314, where image i+1 is printed in black on the back side of the media sheet N+1. Next, at block B324, the media sheet N+1 is sent from the simplex portion 220 into the duplex portion 230, a fourth delay gap is created between the trailing edge of media sheet N+1 and the leading edge of media sheet N, and image i is printed in black on the front side of the media sheet N. Thereafter, routine R20 proceeds to block B330 where the media sheet N is sent to the output area 16. Next at block B332, the media sheet count N is set to N+1 and the image count i is set to I+2 and a block B334 routine R20 returns to the start at block B300.

When block B340 is reached from one of blocks B306 and B308, at block B340 a determination is made whether or not the state flag is set to Color. When it is determined that the state flag is set to Color, then at block B342, the simplex delay gap is created between the media sheet N−1 and N+1.

When, at block B340, it is determined that the state flag is not set to Color, routine R20 proceeds to block B350 where a determination is made whether or not the state flag is set to Retracted. When, at block B350, it is determined that the state flag is not set to Retracted routine R20 proceeds to blocks B356 and B354 where at block 356 the color PC drums 64Y-64M are rotated, the pause counter is reset, the state flag is set to Color and then at block B354 the media sheet N is held in the duplex portion 230.

When, at block B350, it is determined that the state flag is set to Retracted, routine R20 proceeds to blocks B352 and B354 where at block B352 the color transfer rolls 110Y-110M are moved to their respective engaged positions, the black and color PC drums 64K, 64Y-64M are rotated, and the state flag is set to Color, and then at block B354 the media sheet N is held in the duplex portion 230. Alternatively, at block B352, the color PC drums 64Y-64M may be moved to their respective engaged positions.

After reaching one of blocks B354 and B342, routine R20 proceeds to block B344 with image i+1 is printed in color on the back side of the media sheet N+1. Next, at block B360 a determination is made whether or not the media sheet N front side is to have a color image.

On determining that the image for the front side of the media sheet N is in color, at block B362, the media sheet N+1 is sent into the duplex portion from the simplex path, the fourth delay gap is created by the media sheets N and N+1, the image i is printed in color on the front side of the media sheet N. Thereafter, route R20 proceeds to blocks B330, B332, and B334, previously described.

On determining that the image for the front side of the media sheet N is not a color image, at block B366, the rotating color PC drums 64Y-64M are stopped, the color transfer rolls 110Y-110M are moved to their respective engaged positions, the pause counter is started, and the state flag is set to Paused. Alternatively, at block B366, the color PC drums 64Y-64M are moved to their respective engaged positions. Thereafter, route R20 proceeds to blocks B324, B330, B332, and B334, previously described.

Figure 9:
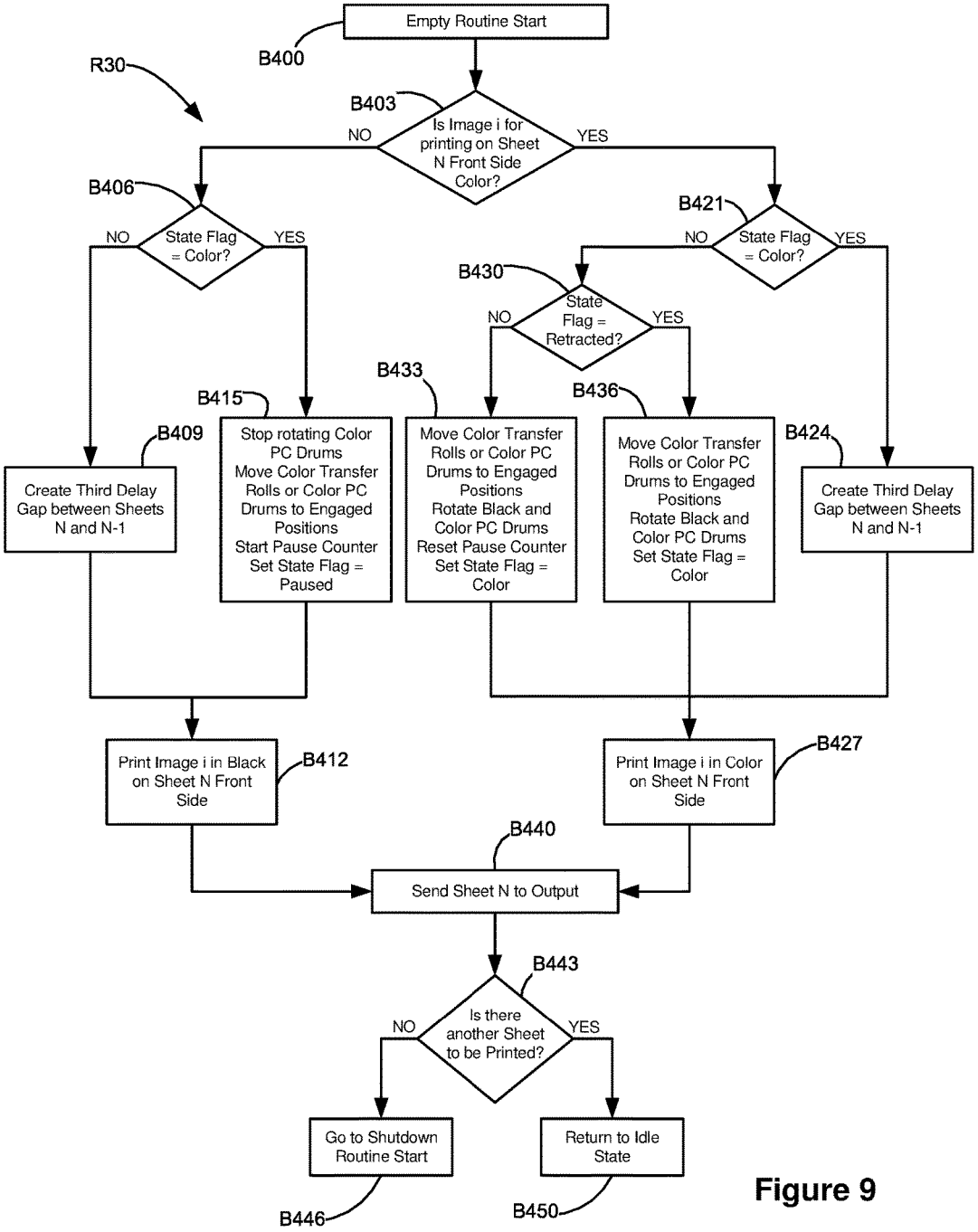
FIG. 9 is a flowchart showing a method of the duplex printing of color and black only images, moving the last media sheet from the duplex path back into the simplex portion of the media transport path and into the media output area.

The empty routine of FIG. 9 is entered via one of blocks B180 and B304. The empty routine R30 starts at block B400. At block B403, a determination is made whether or not image i for printing on the front side of media sheet N is a color image. B421.

When it is determined at block B403 that image i is not a color image, routine R30 proceeds to block B406 where a determination is made whether or not the state flag is set to Color. When it is determined that the state flag is not set to Color, routine R30 proceeds to block B409. At block B409, a third delay gap is created between the leading edge of media sheet N and the trailing edge of media sheet N−1. This third delay gap is typically less than the first and second delays gaps described earlier, as media sheet N does not need to wait for media sheet N−1 which goes directly to the media output area 16. Thereafter, routine R20 proceeds to block B412.

When it is determined at block B406 that the state flag is set to Color, routine 30 proceeds to block B415. At block B415, the rotating color PC drums 64Y-64M are stopped. Color transfer rolls 110Y-110M are moved to their respective engaged positions. Alternatively, at block B415, the color PC drums 64Y-64M are moved to their respective engaged positions. Also at block B415, the pause counter is started and the state flag is set to Paused. Routine R30 then proceeds to block B412.

Block B412 is entered via one of blocks B409 and B415. At block B412, the image i is printed in black on the front side of media sheet N and routine R30 proceeds to block B440 where the media sheet N is sent to the output area 16. Thereafter, routine R30 proceeds to block B443 where a determination is made whether or not there is another media sheet remaining to be printed. Upon determining that there is another media sheet remaining, routine R30 returns to the idle state at block B100. Upon determining that there is no another media sheet remaining, routine R30 goes to block B446 and enter the shutdown route R40, described in FIG. 10.

When it is determined at block B403 that image i is a color image, routine R30 proceeds to block B421 where a determination is made whether or not the state flag is set to one Color.

When it is determined at block B421 that the state flag is set to Color, routine R30 proceeds to block B424 where the third delay gap is created between the leading edge of media sheet N and the trailing edge of media sheet N−1. Thereafter, routine R30 proceeds to block B427.

When it is determined that the state flag is not set to Color, routine R30 proceeds to block B430 where a determination is made whether or not the state flag is set to Retracted. When it is determined that the state flag is not set to Retracted, routine R30 proceed to block B433. At block B433, the color transfer rolls 110Y-110M are moved to their respective engaged positions and the black and color PC drums 64K, 64Y-64M are rotated. Alternatively, at block B433, the color PC drums 64Y-64M are moved to their respective engaged positions. Also at block B433, the pause counter is reset and the state flag is set to Color. Routine R30 proceeds to block B427.

When it is determined that the state flag is set to Retracted at block B430, routine R30 proceed to block B436. At block B436, the color transfer rolls 110Y-110M are moved to their respective engaged positions and the black and color PC drums 64K, 64Y-64M are rotated. Alternatively, at block B436, the color PC drums 64Y-64M are moved to their respective engaged positions. Also at block B436, the state flag is set to Color. Routine R30 proceeds to block B427.

Block B427 is entered via one of blocks B424, B433, and B436. At block B427, the image i is printed in color on the front side of media sheet N and routine R30 proceeds to blocks B440, and B443 and one of blocks B446, B450, as previously described.

Figure 10:
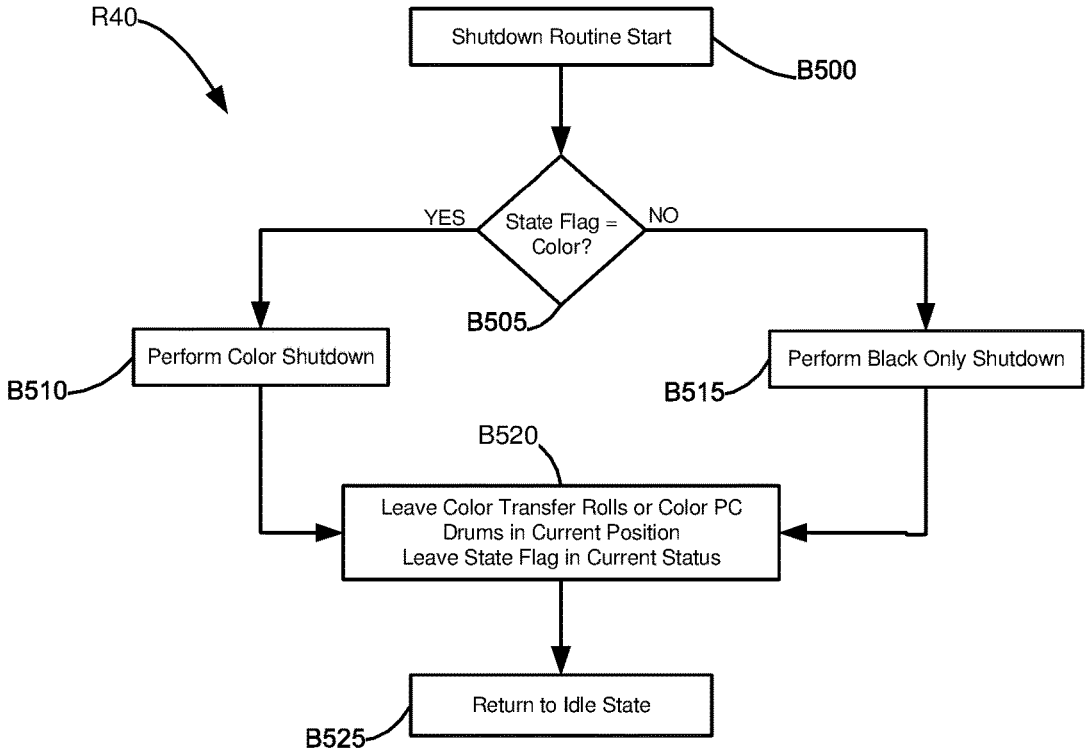
FIG. 10 is a flowchart of one example method for processing a shutdown operation.

The shutdown routine of FIG. 10 is entered via block B446. Shutdown routine R40 begins at block B500. At block B505, a determination is made whether or not the state flag is set to Color. When it is determined that the state flag is set to Color, routine R40 proceeds to block B510. At block B510, a color shutdown is performed such that all drum motors 68Y-68K are stopped, stopping PC drums 64Y-64K. When it is determined at block 505 that the state flag is not set to Color, routine R40 proceeds to block B515. At block B515, a black-only shutdown is performed such that only black drum motor 68K is stopped, stopping rotation of black PC drum 64K. Subsequent to one of blocks B510 and B515, routine R40 proceeds to block B520. At block B520, the current position of each of the color transfer rolls 110Y-110M is maintained and the current status of the state flag is left unchanged. Alternatively, at block 520, the current position of each of the color PC drums 64Y-64M is maintained. Routine R40 then proceeds to block B525 and returns to the idle state at block B100.

The foregoing description of several methods and example embodiments has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of controlling combined simplex and duplex printing of a print job having two or more consecutive images using an imaging device, the imaging device having a media transport path extending from an input media source to a media output area for transporting sheets of media to be printed, the media transport path including a simplex portion having an entrance adjacent the input media source and an exit adjacent the media output area and a duplex portion having an entrance connected to the exit of the simplex portion and an exit connected to the entrance of the simplex portion, a first plurality of media feed rolls positioned along the simplex portion, a second plurality of media feed rolls position along the duplex portion, the first plurality of media feed rolls and second plurality of media feed rolls each independently driven, a media redrive system positioned upstream of the media output area for feeding a printed media sheet out into the media output area or back into the entrance of the duplex portion, a rotating intermediate transfer member (ITM) belt forming an endless loop having an inner surface and an outer surface, a portion of the outer surface for receiving a toned image and positioning the toned image to be adjacent to an image transfer roll positioned along a media transport path for transferring the toned transferred image onto a surface of the media sheet to be printed, a plurality of color imaging units having a color photoconductive (PC) drum and an associated color charging roll in contact therewith, each color PC drum engageable with the ITM belt for depositing a color toned image when present to the outer surface of the ITM belt, a black imaging unit having a black PC drum and an associated black charging roll in contact therewith, the black PC drum engaged with the ITM belt for depositing a black toned image when present to the outer surface of the ITM belt, a black transfer roll being in an engaged position against the inner surface of the ITM belt and positioned to press the outer surface of the ITM belt against the outer surface of the black PC drum, a plurality of retractable color transfer rolls being disposed adjacent to the inner surface of the ITM belt, the plurality of color transfer rollers moveable between an engaged position and a disengaged position wherein when in the engaged position respective ones of the plurality of color transfer rolls press the outer surface of the ITM belt into contact with the outer surface of a respective one of the plurality of color PC drums and, when in the disengaged position, the outer surface of the ITM belt is separated from the outer surface of the respective color PC drum, and a controller communicatively coupled to the plurality of color imaging units, the black imaging unit, the black transfer roll, the plurality of retractable color transfer rolls, the first plurality of media feed rolls, the second plurality of media feed rolls, the media redrive system and configured to control the operation thereof and to perform the method, the method comprising:

beginning in an idle state wherein no media sheets are in the duplex portion;

determining whether or not the print engine is active and upon determining that the print engine is not active, starting the print engine;

initializing a media sheet count N and an image count i;

determining whether or not an image i for printing on a back side of a media sheet N is one of a color image and a black-only image;

upon determining that the image i for printing on the back side of the media sheet N is a color image, moving each respective color transfer roll to its respective engaged position, rotating the black and color PC drums, printing the image i on the back side of the media sheet N in color and setting the state flag to Color;

upon determining that the image i for printing on the back side of the media sheet N is a black-only image, determining whether or not a color image to be printed remains in the print job;

upon determining that a color image remains to be printed, moving each respective color transfer roll to its respective engaged position, rotating the black and color PC drums, printing the image i in black on the back side of the media sheet N, and setting the state flag to Paused;

upon determining that no color image remains to be printed, moving each respective color transfer roll to its respective disengaged position, rotating only the black PC drum, printing the image i in black on the back side of the media sheet N, and setting the state flag to Retracted;

feeding the media sheet N from the simplex portion into the duplex portion;

determining whether or not the media sheet N is a last duplex media sheet in the print job;

upon determining that the media sheet N is not the last duplex media sheet in the print job, determining whether or not an image i+1 for printing on a front side of the media sheet N is one of a color image and a black-only image;

upon determining that the image i+1 for printing on the front side of the media sheet N is a black-only image, determining whether or not an image i+2 for printing on the back side of the media sheet N+1 is one of a color image and a black-only image;

upon determining one of the image i+1 for printing on the front side of the media sheet N is a color image and the image i+2 is a color image, determining whether or not the state flag is set to Color;

upon determining that the state flag is set to Color, creating a first delay gap between a leading edge of the media sheet N and a trailing edge of a media sheet N+1;

upon determining that the state flag is not set to Color, determining whether or not the state flag is set to Retracted;

upon determining that the state flag is not set to retracted, rotating the black and color PC drums, clearing the pause counter; setting the state flag to Color and sending and holding the media sheet N in the duplex portion;

upon determining that the state flag is set to retracted, moving each respective color transfer roll to its respective engaged position, rotating the black and color PC drums, setting the state flag to Color sending and holding the media sheet N in the duplex portion;

printing an image i+2 in color on a back side of the media sheet N+1;

determining whether or not the front side of the media sheet N is color;

upon determining that the front side of media sheet N is color, feeding the media sheet N+1 from the simplex portion into the duplex portion, creating a second delay gap between the leading edge of the media sheet N and the trailing edge of the media sheet N+1, moving the held media sheet N into the simplex portion, printing the image i+1 on the front side of the media sheet N in color, transporting the held media sheet N into the media output area, setting the media sheet count N to N+1 and setting the image count i to i+2;

upon determining that the front side of media sheet N is not color, stopping the rotation of the color PC drums, moving each of the color transfer rolls to its respective engaged position, starting the pause counter, and setting the state flag to Paused, feeding the media sheet N+1 from the simplex portion into the duplex portion, creating a second delay gap between a leading edge of the media sheet N and a trailing edge of the media sheet N+1, moving the held media sheet N into the simplex portion, printing the image i+1 on the front side of the media sheet N in color, sending media sheet N to the output area, setting the media sheet count N to N+1 and setting the image count i to i+2;

upon determining that the image i+2 for printing on the back side of the media sheet N+1 is a black-only image determining whether or not the state flag is set to Color;

upon determining that the state flag is set to Color, stopping rotating the color PC drums, moving each of the color transfer rolls to their respective engaged positions, starting the pause counter and setting the state flag to Paused;

upon determining that the state flag is not set to Color, creating the first delay gap between a leading edge of the media sheet N and a trailing edge of the media sheet N+1;

printing the image i+2 in black on the back side of media sheet N+1;

feeding the media sheet N+1 from the simplex portion into the duplex portion and creating a second delay gap between a leading edge of the media sheet N and a trailing edge of the media sheet N+1, moving the held media sheet N into the simplex portion, printing the image i+1 on the front side of the media sheet N in color, sending media sheet N to the output area, setting the media sheet count N to N+1 and setting the image count i to i+2.

2. The method of claim 1, further comprising:

determining whether or not that the media sheet N is the last duplex media sheet in the print job;

upon determining that the media sheet N is not the last duplex media sheet in the print job, determining whether or not the image i for printing on the front side of the media sheet N is a color image;

upon determining that the image i for printing on the front side of the media sheet N is not a color image, determining whether or not the image i+1 for printing on the back side of media sheet N+1 is a color image;

upon determining one of that the image i for printing on the front side of the media sheet N is a color image and that the image i+1 for printing on the back side of media sheet N+1 is a color image, determining whether or not the state flag is set to Color;

upon determining that the state flag is set to Color, creating a simplex delay gap between the trailing edge of a media sheet N−1 and the leading edge of media sheet N+1;

upon determining that the state flag is not set to Color, determining whether or not the state flag is set to Retracted;

upon determining that the state flag is not set to Retracted, rotating the black and color PC drums, clearing the pause counter and setting the state flag to Color;

upon determining that the state flag is set to Retracted, moving each color transfer roll to its respective engaged position, rotating the black and color PC drums, clearing the pause counter and setting the state flag to Color, and moving media sheet N into the duplex portion;

printing image i+1 in color on the back side of the media sheet N+1;

determining whether or not the front side of the media sheet N is color;

upon determining that the front side of media sheet N is color, sending the media sheet N+1 into the duplex portion, creating a fourth delay gap between the trailing edge of the media sheet N+1 and the leading edge of the media sheet N and N+1, printing image i in color on the media sheet N front side, sending the media sheet N to the media output area; setting the media sheet count N to N+1 and setting the image count i to i+2 and then returning to the step of determining whether or not the media sheet N is the last duplex sheet in the print job;

upon determining that the front side of media sheet N is color, stopping rotating the color PC drums, moving each of the color transfer rolls to its respective engaged position, starting the pause counter, setting the state flag to Paused, sending the media sheet N+1 from the simplex portion into the duplex portion, creating the fourth delay gap between the trailing edge of the media sheet N+1 and the leading edge of the media sheet N, printing image i in black on the front side of media sheet N, sending media sheet N into the output area, incrementing the media sheet count N by one and incrementing the image count i by 2, and returning to the step of determining whether or not the media sheet N is the last duplex media sheet in the print job;

upon determining that the image i+1 for printing on the back side of the media sheet N+1 is not color, determining whether or not the state flag is set to Color;

upon determining that the state flag is set to Color, stopping rotating the color PC drums, moving each color transfer roll to its respective engaged position, starting the pause counter, and setting the state flag to Paused;

upon determining that the state flag is not set to Color, determining whether or not the pause counter has expired and whether or not there are no more color images remaining to be printed;

upon determining one of that the pause counter has not expired and that there are more color images to be printed, creating the simplex delay gap between the trailing edge of a media sheet N−1 and the leading edge of media sheet N+1;

upon determining that the pause counter has expired and that there are no more color images to be printed, moving each color transfer roll to its respective disengaged position, recharging each of the color PC drums, resetting the pause counter, setting the state flag equal to Retracted and moving the media sheet N into the duplex portion;

printing image i+1 in black on the back side of the media sheet N+1;

sending the media sheet N+1 from the simplex portion into the duplex portion, creating the fourth delay gap between media sheets N and N+1 and printing image i in black on the front side of media sheet N; and sending media sheet N into the output area, incrementing the media sheet count N by one and incrementing the image count i by 2, and returning to the step of determining whether or not the media sheet N is the last duplex media sheet in the print job.

3. The method of claim 2, further comprising:

upon determining that the media sheet N is the last duplex media sheet in the print job, determining whether or not image i for printing on the front side of the media sheet N is one of a color image and a black-only image;

upon determining that the image i is a color image, determining whether or not the state flag is set to Color;

upon determining that the state flag is set to Color, creating a third delay gap between the leading edge of the media sheet N and a trailing edge of a media sheet N−1; and upon determining that the state flag is not set to Color, determining whether or not the state flag is set to Retracted;

upon determining that the state flag is set to Retracted, moving each respective color transfer roll to its respective engaged position, rotating the black and color PC drums, and setting the state flag to Color; and upon determining that the state flag is not set to Retracted, moving each respective color transfer roll to its respective engaged position, rotating the black and color PC drums, resetting the pause counter and setting the state flag to Color;

printing image i in color on the front side of the media sheet N, sending the media sheet N to the media output area, and determining whether or not there is another media sheet remaining to be printed;

upon determining that there is another media sheet remaining to be printed, returning to the idle state; and upon determining that there is not another media sheet remaining to be printed, determining whether or not the state flag is set to Color;

upon determining that the state flag is set to Color, performing a color shutdown routine;

upon determining that the state flag is not set to Color, performing a black-only shutdown; and leaving each color transfer roll in its respective current position, leaving the state flag in its current state and returning to the idle state.

4. The method of claim 3, further comprising:

upon determining that the image i is not a color image, determining whether or not the state flag is set to Color;

upon determining that the state flag is not set to Color, creating the third delay gap between the leading edge of the media sheet N and a trailing edge of a media sheet N−1; and upon determining that the state flag is set to Color, stopping rotating each of the color PC drums, moving each color transfer roll to its respective engaged position, starting the pause counter, and setting the state flag to Paused; and printing image i in black on the front side of the media sheet N, sending the media sheet N to the media output area, and determining whether or not there is another media sheet remaining to be printed;

upon determining that there is another media sheet remaining to be printed, returning to the idle state; and upon determining that there is not another media sheet remaining to be printed, determining whether or not the state flag is set to Color;

upon determining that the state flag is set to Color, performing a color shutdown routine;

upon determining that the state flag is not set to Color, performing a black-only shutdown; and leaving each color PC drum in its respective current position, leaving the state flag in its current state and returning to the idle state.

5. A method of controlling complex simplex and duplex printing of a print job having two or more consecutive images using an imaging device, the imaging device having a media transport path extending from an input media source to a media output area for transporting sheets of media to be printed, the media transport path including a simplex portion having an entrance adjacent the input media source and an exit adjacent the media output area and a duplex portion having an entrance connected to the exit of the simplex portion and an exit connected to the entrance of the simplex portion, a first plurality of media feed rolls positioned along the simplex portion, a second plurality of media feed rolls position along the duplex portion, the first plurality of media feed rolls and second plurality of media feed rolls each independently driven, a media redrive system positioned upstream of the media output area for feeding a printed media sheet out into the media output area or back into the entrance of the duplex portion, a rotating intermediate transfer member (ITM) belt forming an endless loop having an inner surface and an outer surface, a portion of the outer surface for receiving a toned image and positioning the toned image to be adjacent to an image transfer roll positioned along a media transport path for transferring the toned transferred image onto a surface of the media sheet to be printed, a plurality of color imaging units including a plurality of retractable color photoconductive (PC) drums, each color PC drum movable between an engaged position and a disengaged position with respect to the outer surface of the ITM belt, each color PC drum depositing a color toned image thereon when present when in the engaged position with the outer surface of the ITM belt, a black imaging unit having a black PC drum and an associated black charging roll in contact therewith, the black PC drum engaged with the ITM belt for depositing a black toned image when present to the outer surface of the ITM belt, a black transfer roll being in an engaged position against the inner surface of the ITM belt and positioned to press the outer surface of the ITM belt against the outer surface of the black PC drum, a plurality of color transfer rolls being disposed adjacent to the inner surface of the ITM belt, the plurality of color transfer rollers aligned with the plurality of color PC drums and engaged with the inner surface of the ITM belts for pressing the outer surface of the ITM belt into contact with the outer surface of a respective one of the plurality of color PC drums when the plurality of color PC drums are in their engaged positions, the plurality of color PC drums when in the disengaged position are separated from the outer surface of the ITM belt, and a controller communicatively coupled to the plurality of color imaging units, the black imaging unit, the black transfer roll, the plurality of movable color PC drums, the first plurality of media feed rolls, the second plurality of media feed rolls, the media redrive system and configured to control the operation thereof and to perform the method, the method comprising:

beginning in an idle state wherein no media sheets are in the duplex portion;

determining whether or not the print engine is active and upon determining that the print engine is not active, starting the print engine;

initializing a media sheet count N and an image count i;

determining whether or not an image i for printing on a back side of a media sheet N is one of a color image and a black-only image;

upon determining that the image i for printing on the back side of the media sheet N is a color image, moving each respective color PC drum to its respective engaged position, rotating the black and color PC drums, printing the image i on the back side of the media sheet N in color and setting the state flag to Color;

upon determining that the image i for printing on the back side of the media sheet N is a black-only image, determining whether or not a color image to be printed remains in the print job;

upon determining that a color image remains to be printed, moving each respective color PC drum to its respective engaged position, rotating the black PC drum, printing the image i in black on the back side of the media sheet N, and setting the state flag to Paused;

upon determining that no color image remains to be printed, moving each respective color PC drum to its respective disengaged position, rotating only the black PC drum, printing the image i in black on the back side of the media sheet N, and setting the state flag to Retracted;

feeding the media sheet N from the simplex portion into the duplex portion;

determining whether or not the media sheet N is a last duplex media sheet in the print job;

upon determining that the media sheet N is not the last duplex media sheet in the print job, determining whether or not an image i+1 for printing on a front side of the media sheet N is one of a color image and a black-only image;

upon determining that the image i+1 for printing on the front side of the media sheet N is a black-only image, determining whether or not an image i+2 for printing on the back side of the media sheet N+1 is one of a color image and a black-only image;

upon determining one of: the image i+1 for printing on the front side of the media sheet N is a color image and the image i+2 is a color image, determining whether or not the state flag is set to Color;

upon determining that the state flag is set to Color, creating a first delay gap between a leading edge of the media sheet N and a trailing edge of a media sheet N+1;

upon determining that the state flag is not set to Color, determining whether or not the state flag is set to Retracted;

upon determining that the state flag is not set to retracted, rotating the black and color PC drums, clearing the pause counter; setting the state flag to Color and sending and holding the media sheet N in the duplex portion;

upon determining that the state flag is set to retracted, moving each respective color PC drum to its respective engaged position, rotating the black and color PC drums, setting the state flag to Color sending and holding the media sheet N in the duplex portion;

printing an image i+2 in color on a back side of the media sheet N+1;

determining whether or not the front side of media sheet N is color;

upon determining that the front side of media sheet N is color, feeding the media sheet N+1 from the simplex portion into the duplex portion, creating a second delay gap between the leading edge of the media sheet N and the trailing edge of the media sheet N+1, moving the held media sheet N into the simplex portion, printing the image i+1 on the front side of the media sheet N in color, and transporting the held media sheet N into the media output area;

upon determining that the front side of media sheet N is not color, stopping the rotation of the color PC drums, moving each of the color PC drums to its respective engaged position, starting the pause counter, and setting the state flag to Paused, feeding the media sheet N+1 from the simplex portion into the duplex portion, creating a second delay gap between a leading edge of the media sheet N and a trailing edge of the media sheet N+1, moving the held media sheet N into the simplex portion, printing the image i+1 on the front side of the media sheet N in color, sending media sheet N to the output area, setting the media sheet count N to N+1, and setting the image count i to i+2;

upon determining that the image i+2 for printing on the back side of the media sheet N+1 is a black-only image determining whether or not the state flag is set to Color;

upon determining that the state flag is set to Color, stopping rotating the color PC drums, moving each of the color PC drums rolls to their respective engaged positions, starting the pause counter and setting the state flag to Paused;

upon determining that the state flag is not set to Color, creating the first delay gap between a leading edge of the media sheet N and a trailing edge of the media sheet N+1;

printing the image i+2 in black on the back side of media sheet N+1; and feeding the media sheet N+1 from the simplex portion into the duplex portion and creating a second delay gap between a leading edge of the media sheet N and a trailing edge of the media sheet N+1, moving the held media sheet N into the simplex portion, printing the image i+1 on the front side of the media sheet N in color, sending media sheet N to the output area, setting the media sheet count N to N+1, and setting the image count i to i+2.

6. The method of claim 5, further comprising:

determining whether or not that the media sheet N is the last duplex media sheet in the print job;

upon determining that the media sheet N is not the last duplex media sheet in the print job, determining whether or not the image i for printing on the front side of the media sheet N is a color image;

upon determining that the image i for printing on the front side of the media sheet N is not a color image, determining whether or not the image i+1 for printing on the back side of media sheet N+1 is a color image;

upon determining one of: the image i for printing on the front side of the media sheet N is a color image and that the image i+1 for printing on the back side of media sheet N+1 is a color image, determining whether or not the state flag is set to Color;

upon determining that the state flag is set to Color, creating a simplex delay gap between the trailing edge of a media sheet N−1 and the leading edge of media sheet N+1;

upon determining that the state flag is not set to Color, determining whether or not the state flag is set to Retracted;

upon determining that the state flag is not set to Retracted, rotating the black and color PC drums, clearing the pause counter and setting the state flag to Color;

upon determining that the state flag is set to Retracted, moving each color PC drum to its respective engaged position, rotating the black and color PC drums, clearing the pause counter and setting the state flag to Color, and moving media sheet N into the duplex portion;

printing image i+1 in color on the back side of the media sheet N+1;

determining whether or not the front side of the media sheet N is color;

upon determining that the front side of media sheet N is color, sending the media sheet N+1 into the duplex portion, creating a fourth delay gap between the trailing edge of the media sheet N+1 and the leading edge of the media sheet N and N+1, printing image i in color on the media sheet N front side, sending the media sheet N to the media output area; setting N=N+1 and setting i=i+2 and then returning to the step of determining whether or not the media sheet N is the last duplex sheet in the print job;

upon determining that the front side of media sheet N is color, stopping rotating the color PC drums, moving each of the color PC drums to its respective engaged position, starting the pause counter, setting the state flag to Paused, sending the media sheet N+1 from the simplex portion into the duplex portion, creating the fourth delay gap between the trailing edge of the media sheet N+1 and the leading edge of the media sheet N, printing image i in black on the front side of media sheet N, sending media sheet N into the output area, setting the media sheet count N to N+1 and setting the image count i to i+2, and returning to the step of determining whether or not the media sheet N is the last duplex media sheet in the print job;

upon determining that the image i+1 for printing on the back side of the media sheet N+1 is not color, determining whether or not the state flag is set to Color;

upon determining that the state flag is set to Color, stopping rotating the color PC drums, moving each color PC drum to its respective engaged position, starting the pause counter, and setting the state flag to Paused;

upon determining that the state flag is not set to Color, determining whether or not the pause counter has expired and whether or not there are no more color images remaining to be printed;

upon determining that one of the pause counter not has expired and that there are more color images to be printed, creating the simplex delay gap between the trailing edge of a media sheet N−1 and the leading edge of media sheet N+1;

upon determining that the pause counter has not expired and that there are no more color images to be printed, moving each color PC drum to its respective disengaged position, recharging each of the color PC drums, resetting the pause counter, setting the state flag equal to Retracted and moving the media sheet N into the duplex portion;

printing image i+1 in black on the back side of the media sheet N+1;

sending the media sheet N+1 from the simplex portion into the duplex portion, creating the fourth delay gap between media sheets N and N+1 and printing image i in black on the front side of media sheet N; and sending media sheet N into the output area, setting the media sheet count N to N+1 and setting the image count i to i+2, and returning to the step of determining whether or not the media sheet N is the last duplex media sheet in the print job.

7. The method of claim 6, further comprising:

upon determining that the media sheet N is the last duplex media sheet in the print job, determining whether or not image i for printing on the front side of the media sheet N is one of a color image and a black-only image;

upon determining that the image i is a color image, determining whether or not the state flag is set to Color;

upon determining that the state flag is set to Color, creating a third delay gap between the leading edge of the media sheet N and a trailing edge of a media sheet N−1; and upon determining that the state flag is not set to Color, determining whether or not the state flag is set to Retracted;

upon determining that the state flag is set to Retracted, moving each respective color PC drum roll to its respective engaged position, rotating the black and color PC drums, and setting the state flag to Color; and upon determining that the state flag is not set to Retracted, moving each respective color PC drum roll to its respective engaged position, rotating the black and color PC drums, resetting the pause counter and setting the state flag to Color;

printing image i in color on the front side of the media sheet N, sending the media sheet N to the media output area, and determining whether or not there is another media sheet remaining to be printed;

upon determining that there is another media sheet remaining to be printed, returning to the idle state; and upon determining that there is not another media sheet remaining to be printed, determining whether or not the state flag is set to Color;

upon determining that the state flag is set to Color, performing a color shutdown routine;

upon determining that the state flag is not set to Color, performing a black-only shutdown; and leaving each color PC drum roll in its respective current position, leaving the state flag in its current state and returning to the idle state.

8. The method of claim 7, further comprising:

upon determining that the image i is not a color image, determining whether or not the state flag is set to Color;

upon determining that the state flag is not set to Color, creating the third delay gap between the leading edge of the media sheet N and a trailing edge of a media sheet N−1; and upon determining that the state flag is set to Color, stopping rotating each of the color PC drums, moving each color PC drum to its respective engaged position, starting the pause counter, and setting the state flag to Paused; and printing image i in black on the front side of the media sheet N, sending the media sheet N to the media output area, and determining whether or not there is another media sheet remaining to be printed;

upon determining that there is another media sheet remaining, returning to the idle state; and upon determining that there is not another media sheet remaining to be printed, determining whether or not the state flag is set to Color;

upon determining that the state flag is set to Color, performing a color shutdown routine;

upon determining that the state flag is not set to Color, performing a black-only shutdown; and leaving each color PC drum in its respective current position, leaving the state flag in its current state and returning to the idle state.

* * * * *